US010062327B2

(12) United States Patent
Tani et al.

(10) Patent No.: US 10,062,327 B2
(45) Date of Patent: Aug. 28, 2018

(54) DATA DRIVER AND ORGANIC LIGHT EMITTING DISPLAY PANEL, DISPLAY DEVICE, AND DRIVING METHOD FOR SENSING AND COMPENSATING A MOBILITY OF THE DRIVING TRANSISTOR

(71) Applicant: LG DISPLAY CO., LTD., Seoul (KR)

(72) Inventors: Ryosuke Tani, Paju-si (KR); KyungHyun Choi, Jeongeup-si (KR); ChangHoon Han, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 60 days.

(21) Appl. No.: 15/167,419

(22) Filed: May 27, 2016

(65) Prior Publication Data

US 2016/0351096 A1 Dec. 1, 2016

(30) Foreign Application Priority Data

May 29, 2015 (KR) ..... 10-2015-0076710

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0417* (2013.01); *G09G 2300/0452* (2013.01); *G09G 2300/0465* (2013.01); *G09G 2310/061* (2013.01); *G09G 2320/0295* (2013.01); *G09G 2320/045* (2013.01); *G09G 2320/0693* (2013.01)

(58) Field of Classification Search
CPC ..... G09G 2320/045; G09G 2320/0693; G09G 2320/0295; G09G 2310/061; G09G 3/3233; G09G 3/3291; G09G 2300/0417; G09G 2300/0452; G09G 2300/0465
See application file for complete search history.

(56) References Cited

U.S. PATENT DOCUMENTS 9,224,357 B2 * 12/2015 Kim ..... G09G 3/30
2006/0221015 A1 * 10/2006 Shirasaki ..... G09G 3/325 345/77
2008/0024400 A1 * 1/2008 Uchino ..... G09G 3/3233 345/77

(Continued)

FOREIGN PATENT DOCUMENTS

CN 101136175 A 3/2008
CN 101477783 A 7/2009

(Continued)

*Primary Examiner* — Darlene M Ritchie
(74) *Attorney, Agent, or Firm* — Birch, Stewart, Kolasch & Birch, LLP

(57) ABSTRACT

The present exemplary embodiments relate to measurement of a characteristic of a driving transistor and sensing driving therefor. Provided are a data driver, an organic light emitting display panel, an organic light emitting display device, and a driving method thereof which are capable of measuring characteristics of a driving transistor even at a data voltage which is not so high within a short sensing time by simultaneously sensing the characteristics of the driving transistors for two or more sub pixels, among a plurality of sub pixels commonly connected to the sensing lines, while measuring characteristics (for example, a threshold voltage or a mobility) of the driving transistor.

15 Claims, 18 Drawing Sheets

(56) References Cited

U.S. PATENT DOCUMENTS

| | | | | |
|---|---|---|---|---|
| 2009/0174628 | A1* | 7/2009 | Wang | G09G 3/3225 345/76 |
| 2010/0033410 | A1* | 2/2010 | Ishii | G09G 3/3233 345/77 |
| 2011/0298836 | A1* | 12/2011 | Komiya | G09G 3/3233 345/690 |
| 2013/0027383 | A1* | 1/2013 | Odawara | G09G 3/3233 345/212 |
| 2014/0022289 | A1* | 1/2014 | Lee | G09G 3/3283 345/691 |
| 2016/0027382 | A1* | 1/2016 | Chaji | G09G 3/006 345/212 |
| 2017/0148385 | A1* | 5/2017 | Kishi | G09G 3/3233 |
| 2017/0169767 | A1* | 6/2017 | Song | G09G 3/3291 |
| 2017/0263182 | A1* | 9/2017 | Azizi | G09G 3/3696 |

FOREIGN PATENT DOCUMENTS

| | | | |
|---|---|---|---|
| CN | 102428510 | A | 4/2012 |
| CN | 102968954 | A | 3/2013 |
| CN | 103165078 | A | 6/2013 |
| CN | 103177685 | A | 6/2013 |
| CN | 104637440 | A | 5/2015 |

* cited by examiner

FIG. 14

K=4, S=2

| NO | SUB PIXEL |
|---|---|
| 1 | R, W |
| 2 | W, B |
| 3 | B, G |
| 4 | G, R |
| 5 | W, G |
| 6 | R, B |

K=4, S=3

| NO | SUB PIXEL |
|---|---|
| 1 | R, W, G |
| 2 | W, G, B |
| 3 | G, B, R |
| 4 | B, R, W |
| 5 | R, W, G |
| 6 | W, G, B |
| 7 | G, B, R |
| 8 | B, R, W |

K=4, S=4

| NO | SUB PIXEL |
|---|---|
| 1 | R, W, G, B |
| 2 | R, W, G, B |
| 3 | R, W, G, B |
| 4 | R, W, G, B |
| 5 | R, W, G, B |
| 6 | R, W, G, B |
| 7 | R, W, G, B |
| 8 | R, W, G, B |
| 9 | R, W, G, B |
| 10 | R, W, G, B |

VDATAs_W=VDATAsm_W+Vth_COMP_W
VDATAs_G= VDATAsm_G+Vth_COMP_G
(VDATAsm_W=VDATAsm_G)

DATA DRIVER AND ORGANIC LIGHT EMITTING DISPLAY PANEL, DISPLAY DEVICE, AND DRIVING METHOD FOR SENSING AND COMPENSATING A MOBILITY OF THE DRIVING TRANSISTOR

CROSS-REFERENCE TO RELATED APPLICATIONS

This application claims priority from Korean Patent Application No. 10-2015-0076710 filed on May 29, 2015, which is hereby incorporated by reference for all purposes as if fully set forth herein.

BACKGROUND OF THE INVENTION

Field of the Invention

The present exemplary embodiments relate to a data driver, an organic light emitting display panel, an organic light emitting display device, and a method for driving an organic light emitting display device.

Description of the Related Art

An organic light emitting display device which is getting the spotlight as a display device in recent years uses a self-emitting organic light emitting diode (OLED). Therefore, the organic light emitting display device has a high response speed and is advantageous in terms of a contrast ratio, emission efficiency, brightness, and a viewing angle.

Each sub pixel of the light emitting display device may include an organic light emitting diode and a driving transistor which drives the organic light emitting diode.

In the meantime, the driving transistor in each sub pixel has unique characteristics such as a threshold value or mobility. Further, each driving transistor is being degraded in accordance with a driving time, so that the unique characteristics may be changed.

Due to this feature, degrees of degradation between driving transistors may be different in accordance with difference of driving times between driving transistors in each sub pixel. Further, the characteristic deviation may be caused between the driving transistors.

The characteristic deviation between the driving transistors may be a main cause of a brightness deviation between sub pixels, thereby lowering an image quality.

Therefore, various techniques for compensating a characteristic deviation between the driving transistors have been developed.

However, there may be still a problem in that a characteristic sensing which is inevitably necessary to compensate the characteristic deviation between driving transistors is not precisely performed. In particular, it is significantly difficult to precisely sense a mobility which represents a current capability of a driving transistor due to various reasons.

SUMMARY OF THE INVENTION

An aspect of the present exemplary embodiments is to provide a data driver, an organic light emitting display panel, an organic light emitting display device, and a method for driving an organic light emitting display device which are capable of more precisely sensing and compensating a characteristic of a driving transistor.

Another aspect of the present exemplary embodiments is to provide a data driver, an organic light emitting display panel, an organic light emitting display device, and a method for driving an organic light emitting display device which are capable of sensing a characteristic of a driving transistor within a short sensing time in spite of a voltage which is not so high and an insufficient current capability of the driving transistor.

Still another aspect of the present exemplary embodiments is to provide a data driver, an organic light emitting display panel, an organic light emitting display device, and a method for driving an organic light emitting display device which are capable of sensing a characteristic of a driving transistor within a short sensing time at a voltage which is not so high without increasing a size of the driving transistor.

Still another aspect of the present exemplary embodiments is to provide a data driver, an organic light emitting display panel, an organic light emitting display device, and a method for driving an organic light emitting display device which are capable of sensing a characteristic of a driving transistor within a short sensing time at a voltage which is not so high while achieving a high resolution and a high aperture ratio.

According to an aspect of the present disclosure, there is provided an organic light emitting display device, including: an organic light emitting display panel in which a plurality of data lines and a plurality of gate lines are disposed, a plurality of sub pixels each including an organic light emitting diode and a driving transistor which drives the organic light emitting diode are disposed, and at least one of the sensing lines is disposed corresponding to K ($K \geq 2$) data lines, a data driver which outputs a data voltage to each of the plurality of data lines, and, a gate driver which drives the plurality of gate lines.

Herein, the data driver may simultaneously output sensing data voltages to S ($2 \leq S \leq K$) data lines among K data lines corresponding to one sensing line, while measuring a characteristic of the driving transistors.

The data driver may output a predetermined black data voltage which is defined as a non-sensing data voltage, to K−S data lines excluding the S data lines to which the sensing data voltage is output, from the K data lines, while measuring the characteristic of the driving transistor.

According to an aspect of the present disclosure, there is provided a driving method of an organic light emitting display device which includes: an organic light emitting display panel in which a plurality of data lines and a plurality of gate lines are disposed, a plurality of sub pixels each including an organic light emitting diode and a driving transistor which drives the organic light emitting diode are disposed, and at least one of the sensing lines is disposed corresponding to K ($K \geq 2$) data lines; a data driver which outputs a data voltage to each of the plurality of data lines; and a gate driver which drives the plurality of gate lines.

The driving method of an organic light emitting display device may include simultaneously outputting sensing data voltages to S ($2 \leq S \leq K$) data lines among K data lines corresponding to one sensing line, while measuring a characteristic of the driving transistors and sensing a voltage of a sensing line corresponding to the K data lines.

In the outputting of sensing data voltages, the organic light emitting display device may output a black data voltage which is defined in advance as a non-sensing data voltage to the K−S data lines while outputting the sensing data voltage to the S data lines.

According to still another aspect of the present disclosure, there is provided an organic light emitting display panel including: a plurality of data lines disposed in a first direction; a plurality of gate lines disposed in a second direction; a plurality of sub pixels each including an organic light emitting diode and a driving transistor which drives the organic light emitting diode; and at least one sensing line which is disposed for every K (K≥2) sub pixel column.

The organic light emitting display panel may perform sensing driving to measure a characteristic of the driving transistor and S (2≤S≤K) sub pixels among K sub pixels commonly connected to each of the sensing line may be simultaneously supplied with a sensing data voltage and K−S sub pixels may be simultaneously supplied with a non-sensing data voltage (for example, a predetermined black data voltage) during the sensing driving.

According to still another aspect of the present disclosure, there is provided a data driver including: a latch unit which stores data corresponding to a plurality of channels corresponding to a plurality of data line, a digital to analog converter which converts the data into an analog voltage for each of the plurality of channels and an output unit which outputs a data voltage to the plurality of channels, based on the analog voltage.

The output unit of the data driver may simultaneously output sensing data voltages to S (2≤S≤K) data lines among K (K≥2) data lines corresponding to one sensing line, while data driving to measure a characteristic of the driving transistors in an organic light emitting display panel.

Further, the output unit may output a predetermined black data voltage as a non-sensing data voltage to K−S data lines excluding the S data lines to which the sensing data voltage is output, from the K data lines corresponding to one sensing line.

According to the present exemplary embodiment, a data driver, an organic light emitting display panel, an organic light emitting display device, and a method for driving an organic light emitting display device which may more precisely sense and compensate a characteristic of a driving transistor may be provided.

According to the present exemplary embodiments, a data driver, an organic light emitting display panel, an organic light emitting display device, and a method for driving an organic light emitting display device which are capable of sensing a characteristic of a driving transistor within a short sensing time in spite of a voltage which is not so high and an insufficient current capability of the driving transistor may be provided.

According to the present exemplary embodiments, a data driver, an organic light emitting display panel, an organic light emitting display device, and a method for driving an organic light emitting display device which are capable of sensing a characteristic of a driving transistor within a short sensing time at a voltage which is not so high may be provided without increasing a size of the driving transistor.

According to the present exemplary embodiments, a data driver, an organic light emitting display panel, an organic light emitting display device, and a method for driving an organic light emitting display device which are capable of sensing a characteristic of a driving transistor within a short sensing time at a voltage which is not so high with a high resolution and a high aperture ratio may be provided.

BRIEF DESCRIPTION OF THE DRAWINGS

The above and other aspects, features and other advantages of the present disclosure will be more clearly understood from the following detailed description taken in conjunction with the accompanying drawings, in which:

FIG. 14 illustrates exemplary views of a sensing order when two or more sub pixels are simultaneously sensed among four sub pixels commonly connected to one sensing line when mobility sensing according to the present exemplary embodiments is performed;

DETAILED DESCRIPTION OF THE PREFERRED EMBODIMENTS

Figure 1:
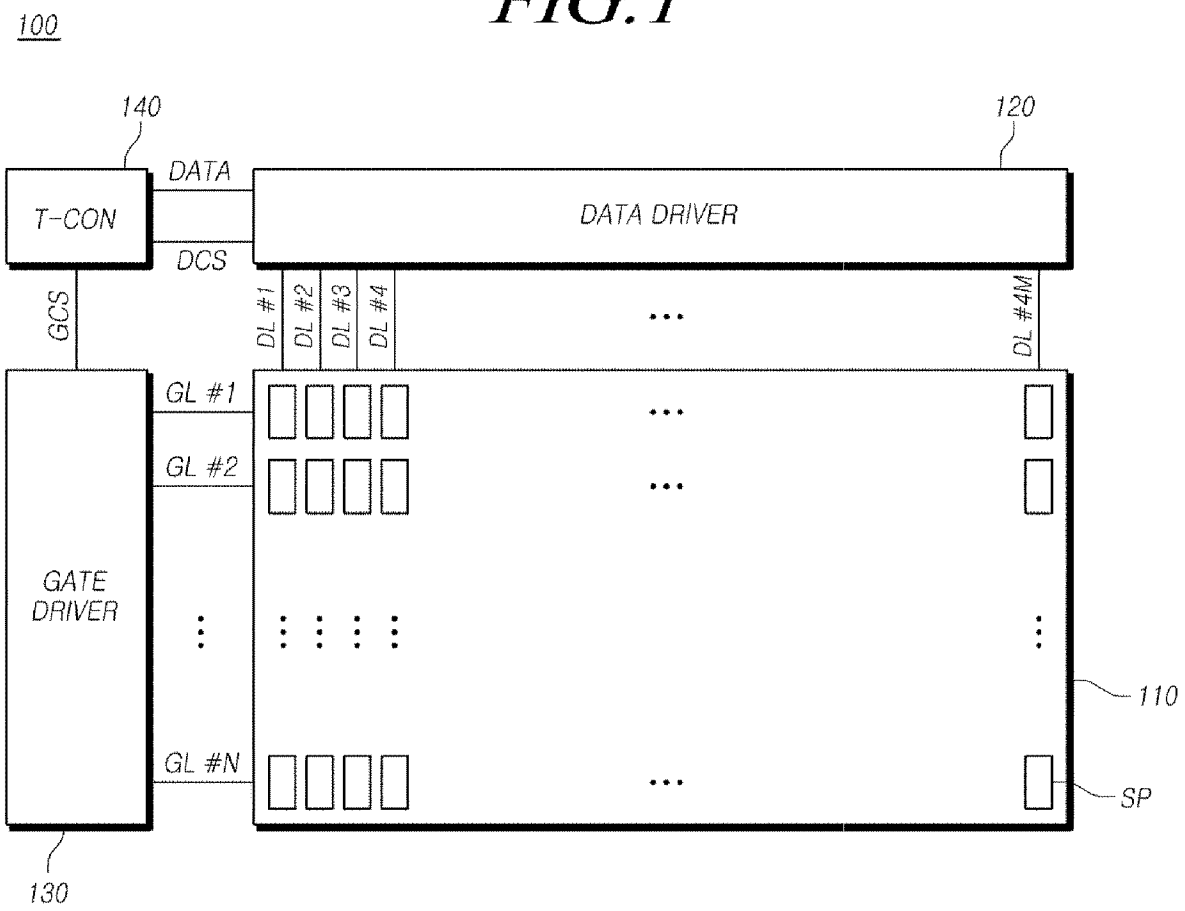
FIG. 1 is a schematic system configuration view of an organic light emitting display device according to the present exemplary embodiments.

Hereinafter, some embodiments of the present discloses will be described in detail with reference to the accompanying drawings. When reference numerals refer to components of each drawing, although the same components are illustrated in different drawings, the same components are referred to by the same reference numerals as possible. Further, if it is considered that description of related known configuration or function may cloud the gist of the present disclosure, the description thereof will be omitted.

Further, in describing components of the present discloses, terminologies such as first, second, A, B, (a), (b), and the like may be used. The terminology is used to distinguish a component from the other component but a nature, an order, or the number of the components is not limited by the terminology. If it is described that a component is "connected" or "coupled" to another component, it is understood that the component is directly connected or coupled to the other component but another component may be "connected" or "coupled" between the components.

FIG. 1 is a schematic system configuration view of an organic light emitting display device 100 according to the present exemplary embodiments. All the components of the organic light emitting display device according to all embodiments are operatively coupled and configured.

Referring to FIG. 1, the organic light emitting display device 100 according to the exemplary embodiments includes an organic light emitting display panel 110, a data driver 120, a gate driver 120, and a timing controller (T-CON) 140. In the organic light emitting display panel 110, a plurality of data lines DL #1, DL #2, . . . , DL #4M (M is a natural number which is equal to or larger than 1) is disposed in a first direction (for example, a column direction), a plurality of gate lines GL #1, GL #2, . . . , GL #N (N is a natural number which is equal to or larger than 1) is disposed in a second direction (for example, a row direction), and a plurality of sub pixels SP is disposed in a matrix. The data driver 120 drives the plurality of data lines DL #1, DL #2, . . . , DL #4M. The gate driver 130 drives the plurality of gate lines GL #1, GL #2, . . . , GL #N. The timing controller 140 controls the data driver 120 and the gate driver 130.

The data driver 120 drives the plurality of data lines by supplying a data voltage to the plurality of data lines DL #1, DL #2, . . . , DL #4M.

The gate driver 130 sequentially drives the plurality of gate lines GL #1, GL #2, . . . , GL #N by sequentially supplying a scan signal to the plurality of gate lines GL #1, GL #2, . . . , GL #N.

The timing controller 140 supplies various control signals to the data driver 120 and the gate driver 130 to control the data driver 120 and the gate driver 130.

The timing controller 140 starts scanning according to a timing implemented in each frame, converts input image data input from the outside to be suitable for a data signal form used by the data driver 120 to output the converted image data DATA. The timing controller 140 controls data driving at a proper time in accordance with the scanning.

The gate driver 130 sequentially supplies a scan signal of an on-voltage or an off-voltage to the plurality of gate lines GL #1, GL #2, . . . , GL #N to sequentially drive the plurality of gate lines GL #1, GL #2, . . . , GL #N in accordance with the control of the timing controller 140.

According to a driving method, as illustrated in FIG. 1, the gate driver 130 may be located only at one side of the organic light emitting display panel 110 or located at both sides if necessary.

Further, the gate driver 130 may include one or more gate driver integrated circuits.

Each of the gate driver integrated circuits may be connected to a bonding pad of the organic light emitting display panel 110 through a tape automated bonding (TAB) method or a chip on glass (COG) method. Each of the gate driver integrated circuits may also be implemented in a gate in panel (GIP) type to be directly disposed in the organic light emitting display panel 110, or may be integrated to be disposed in the organic light emitting display panel 110, if necessary.

Each of gate driver integrated circuits may include a shift register or a level shifter.

When a specific gate line is open, the data driver 120 converts the image data DATA received from the timing controller 140 into an analog data voltage. The data driver 120 supplies the analog data voltage to the plurality of data lines DL #1, DL #2, . . . , DL #4M to drive the plurality of data lines DL #1, DL #2, . . . , DL #4M.

The data driver 120 includes at least one source driver integrated circuit to drive the plurality of data lines DL #1, DL #2, . . . , DL #4M.

Each of the source driver integrated circuits may be connected to the bonding pad of the organic light emitting display panel 110 through a tape automated bonding (TAB) method or a chip on glass (COG) method. Each of the source driver integrated circuits may also be directly disposed in the organic light emitting display panel 110, or may be integrated to be disposed in the organic light emitting display panel 110, if necessary.

Each of the source driver integrated circuits may include a logic unit including a shift register or a latch circuit, a digital analog converter DAC, and an output buffer. If necessary, the source driver integrated circuit may further include a sensing unit which senses a characteristic of a sub pixel to compensate the characteristic (for example, a threshold voltage and a mobility of the driving transistor, a threshold voltage of the organic light emitting diode, or a brightness of the sub pixel).

Each of the source driver integrated circuits may be implemented in a chip on film (COF) type. In this case, one end of each of the source driver integrated circuits is bonded to one source printed circuit board and the other end is bonded to the organic light emitting display panel 110.

In the meantime, the timing controller 140 receives various timing signals including a vertical synchronization signal Vsync, a horizontal synchronization signal Hsync, an input data enable (DE: data enable) signal, and a clock signal CLK together with the input image data, from the outside (for example, a host system).

The timing controller 140 converts the input image data input from the outside to be suitable for a data signal form used in the data driver 120 to output the converted image data. In addition, in order to control the data driver 120 and the gate driver 130, the timing controller 140 receives the timing signal such as the vertical synchronization signal Vsync, the horizontal synchronization signal Hsync, the input DE signal, and the clock signal to generate various control signals, thereby outputting the controls signals to the data driver 120 and the gate driver 130.

For example, in order to control the gate driver 130, the timing controller 140 outputs various gate control signals GCS including a gate start pulse GSP, a gate shift clock GSC, and a gate output enable signal GOE.

Here, the gate start pulse GSP controls an operation start timing of one or more gate driver integrated circuits which configure the gate driver 130. The gate shift clock GSC is a clock signal which is commonly input to one or more gate driver integrated circuits and controls a shift timing of the scan signal (gate pulse). The gate output enable signal GOE designates timing information of one or more gate driver integrated circuits.

Further, in order to control the data driver 120, the timing controller 140 outputs various data control signals DCS including a source start pulse SSP, a source sampling clock SSC, and a source output enable signal SOE.

Here, the source start pulse SSP controls a data sampling start timing of one or more source driver integrated circuits which configure the data driver 120. The source sampling clock SSC is a clock signal which controls a sampling timing of data in each of the source driver integrated circuits. The source output enable signal SOE controls an output timing of the data driver 120.

Referring to FIG. 1, the timing controller 140 may be disposed in a control printed circuit board which is connected to a source printed circuit board to which the source driver integrated circuit is bonded, through a connecting medium such as a flexible flat cable (FFC) or a flexible printed circuit (FPC).

In such a control printed circuit board, a power controller (not illustrated) which supplies various voltages or currents to the organic light emitting display panel 110, the data driver 120, and the gate driver 130 or controls the various voltages or currents to be supplied may be further disposed. Such a power controller is also referred to as a power management IC.

The above-mentioned source printed circuit board and control printed circuit board may be formed as one printed circuit board.

In the organic light emitting display device 100 according to the present exemplary embodiments, each sub pixel SP disposed in the organic light emitting display panel 110 may be configured by circuit components such as an organic light emitting diode (OLED), two or more transistors, and at least one capacitor.

The type and the number of circuit components which configure each sub pixel may be diversely determined in accordance with a providing function and a design method.

In the organic light emitting display panel 110 according to the present exemplary embodiments, each sub pixel may have a circuit structure which compensates a sub pixel characteristic such as a characteristic (for example, a threshold voltage) of the organic light emitting diode (OLED) or a characteristic (for example, a threshold voltage or a mobility) of a driving transistor which drives the organic light emitting diode (OLED).

Figure 2:
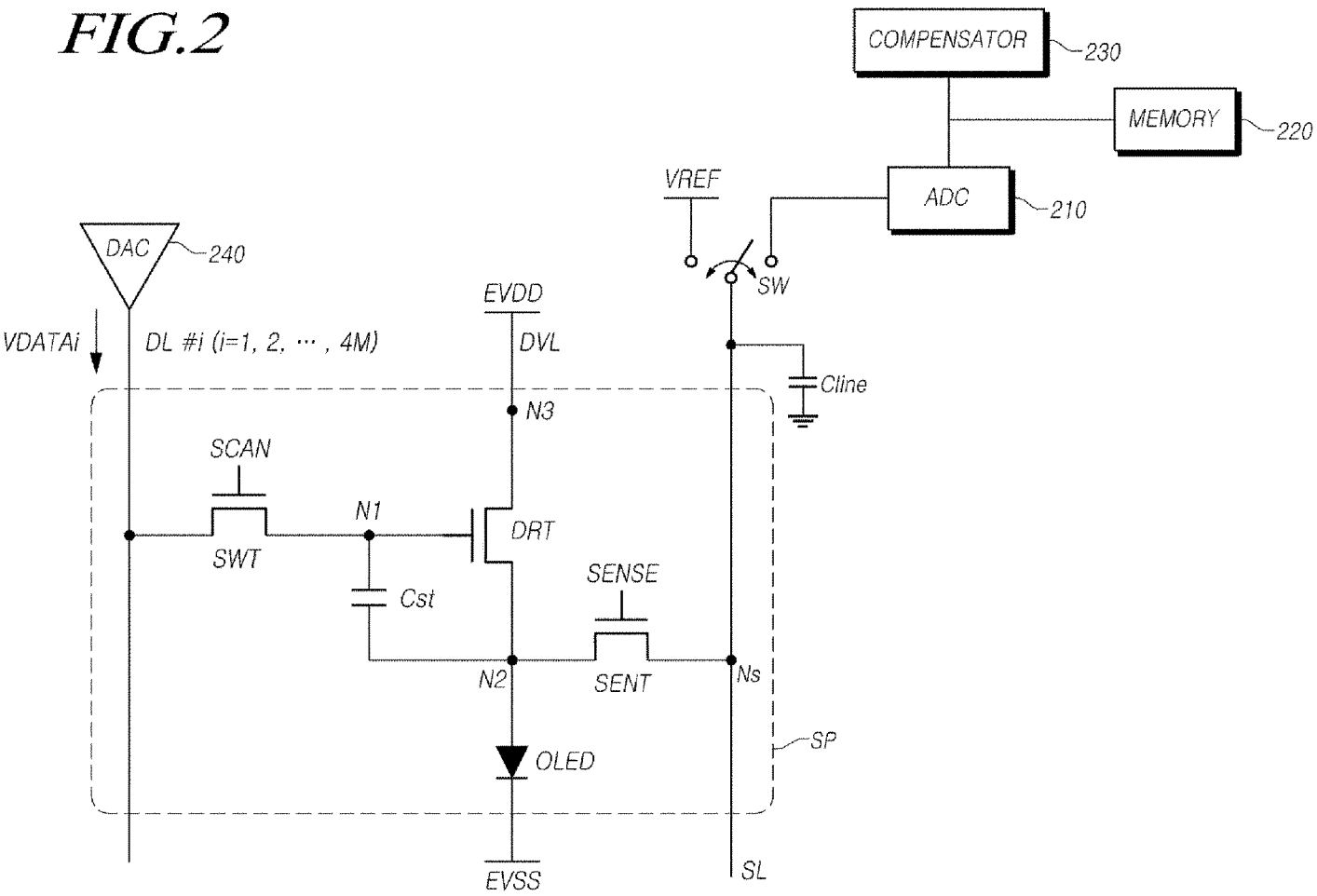
FIG. 2 is an example of a sub pixel compensating circuit in an organic light emitting display panel according to the present exemplary embodiments.
Figure 3:
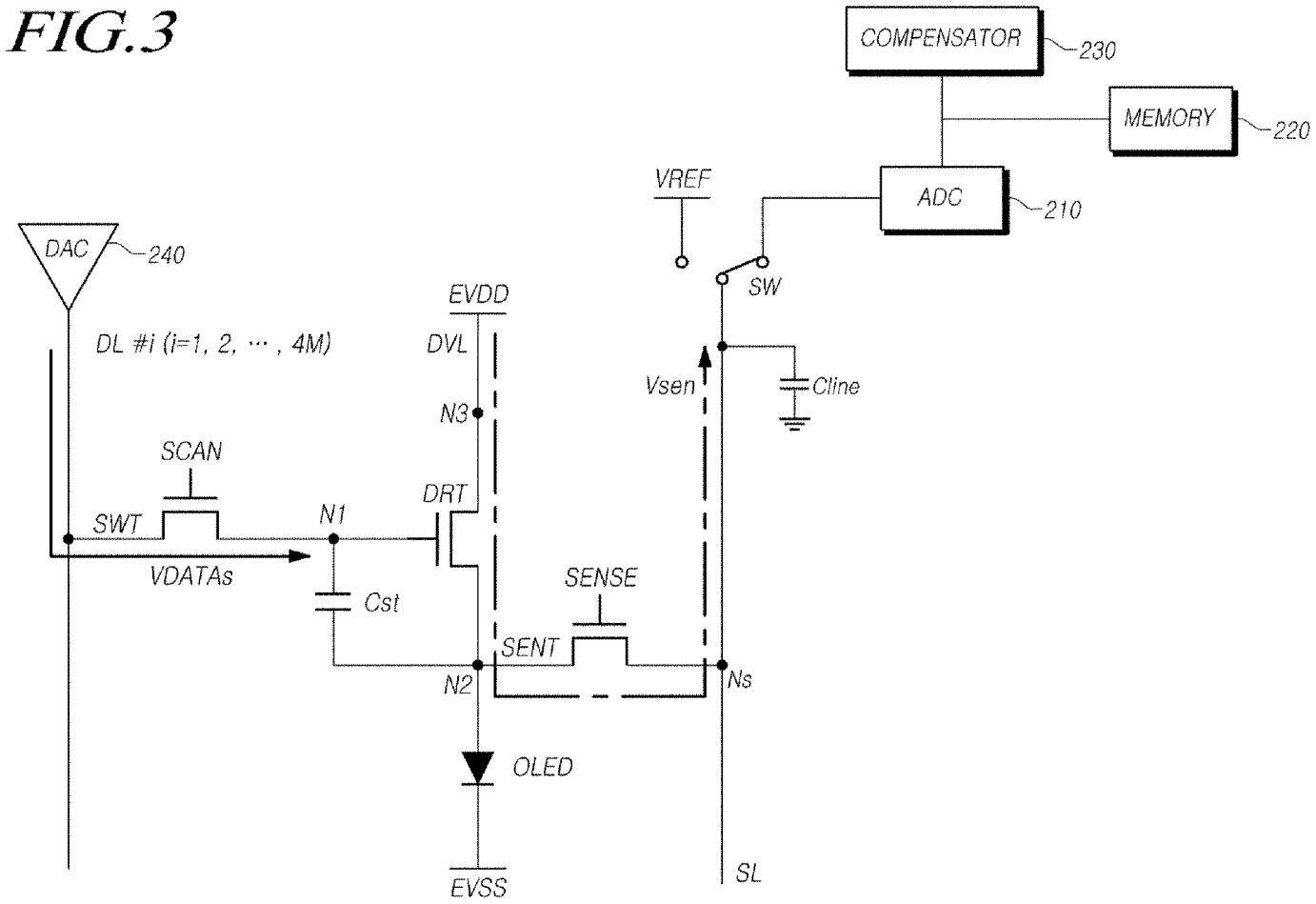
FIG. 3 is a view illustrating mobility sensing according to the present exemplary embodiments.

FIG. 2 is an example of a sub pixel compensating circuit in an organic light emitting display panel 110 according to the present exemplary embodiments. FIG. 3 is a view illustrating mobility sensing according to the present exemplary embodiments.

Referring to FIG. 2, in the organic light emitting display panel 110 according to the present exemplary embodiments, each sub pixel SP is one of N sub pixels included in an i-th (I=1, 2, . . . , 4M) sub pixel column.

Referring to FIG. 2, each sub pixel SP may include an organic light emitting diode OLED, a driving transistor DRT which drives the organic light emitting diode OLED, a storage capacitor Cst electrically connected between a first node N1 and a second node N2 of the driving transistor DRT, a first transistor SWT which is controlled by a first scan signal SCAN and is electrically connected between the first node N1 of the driving transistor DRT and a corresponding data line DL #i, and a second transistor SENT which is controlled by a second scan signal SENSE and is electrically connected between the second node N2 of the driving transistor DRT and a corresponding sensing line SL.

Referring to FIG. 2, the organic light emitting diode OLED is formed by a first electrode (for example, an anode electrode or a cathode electrode), an organic layer, and a second electrode (for example, a cathode electrode or an anode electrode).

For example, the second node N2 of the driving transistor DRT is connected to the first electrode of the organic light emitting diode OLED and a ground voltage EVSS may be applied to the second electrode of the organic light emitting diode OLED.

The driving transistor DRT supplies a driving current to the organic light emitting diode OLED to drive the organic light emitting diode OLED. The driving transistor has a second node N2 corresponding to a source node or a drain node, a first node N1 corresponding to a gate node, and a third node N3 corresponding to a drain node or a source node.

For example, in the driving transistor DRT, the first node N1 may be electrically connected to a source node or a drain node of the first transistor SWT. The second node N2 may be electrically connected to the first electrode of the organic light emitting diode OLED. Further, the third node N3 may be electrically connected to a driving voltage line DVL which supplies a driving voltage EVDD.

The first transistor SWT transmits a data voltage VDATAi to the first node N1 of the driving transistor DRT and is electrically connected between the first node N1 of the driving transistor DRT and the data line DL #i. The first transistor SWT is turned on by a first scan signal SCAN which is applied to the gate node to transmit the data voltage VDATA to the first node N1 of the driving transistor DRT.

The storage capacitor Cst is electrically connected between the first node N1 and the second node N2 of the driving transistor DRT to maintain a predetermine voltage for one frame.

The second transistor SENT is electrically connected between the second node N2 of the driving transistor DRT and the sensing line SL and is controlled by the second scan signal SENSE which is applied to the gate node.

Here, at least one sensing line SL may be disposed on the organic light emitting display panel 110.

In other words, the sensing line SL may be disposed such that, every sensing line corresponds to every one of K (K≥2) sub pixel columns, that is, K data lines. For example, in the organic light emitting display panel 110 having 4M sub pixel columns, 4M/K sensing lines may be disposed. Such a sensing line SL may also be referred to as a reference voltage line.

Even though one sensing line SL corresponds to K data lines, there may be various arrangement directions. For example, an arrangement direction of the sensing line SL may be same as the data line direction or same as the gate line direction.

The second transistor SENT is turned on to apply a reference voltage VREF supplied through the sensing line RVL to the second node N2 of the driving transistor DRT.

The gate node of the first transistor SWT and the gate node of the second transistor SENT may be commonly connected to the same gate line. In this case, the first scan signal SCAN and the second scan signal SENSE are the same gate signal.

On the contrary, the gate node of the first transistor SWT and the gate node of the second transistor SENT may be connected to different gate lines. In this case, the first scan signal SCAN and the second scan signal SENSE are different gate signals.

In the meantime, each driving transistor DRT has a unique characteristic such as a threshold voltage Vth or a mobility.

Further, each driving transistor DRT is being degraded in accordance with a driving time, so that the unique characteristic may be changed.

Due to this feature, degrees of degradation between the driving transistors DRT may be different in accordance with a difference of driving times between the driving transistors DRT in each sub pixel. Further, the characteristic deviation may be caused between the driving transistors DRT.

The characteristic deviation between the driving transistors DRT may be a main cause of a brightness deviation between sub pixels, which may result in lowering an image quality.

There may be not only the characteristic deviation (a threshold voltage deviation or a mobility deviation) between the driving transistors DRT, but also the characteristic deviation (a threshold voltage deviation) between the organic light emitting diodes OLED.

In this specification, both the characteristic deviation between the driving transistors DRT and the characteristic deviation between the organic light emitting diodes OLED are referred to as a "sub pixel characteristic deviation".

Accordingly, in order to improve an image quality, the sub pixel characteristic deviation needs to be compensated.

Therefore, the organic light emitting display device 100 according to the present exemplary embodiments, as illustrated in FIG. 2, has a sub pixel structure which senses and compensates a sub pixel characteristic deviation.

Further, the organic light emitting display device 100 according to the present exemplary embodiments may include a sensing configuration to sense a sub pixel characteristic deviation for each sub pixel and a compensating configuration to compensate the sub pixel characteristic deviation using the result sensed by the sensing configuration.

Referring to FIG. 2, the organic light emitting display device 100 according to the present exemplary embodiments may include at least one analog to digital converter 210 as a sensing configuration to sense a sub pixel characteristic deviation for each sub pixel. At least one analog to digital converter 210 is electrically connected to each of the plurality of sensing lines SL through a switch SW, senses a voltage of each sensing line SL, and converts the sensed voltage value into a digital value to output the value.

The analog to digital converter ADC 210 may be included in the data driver 120. More specifically, at least one analog to digital converter 210 may be included in each source driver integrated circuit included in the data driver 120.

The analog to digital converter 210 senses a voltage of each sensing line SL, converts the sensed voltage value into a digital value to output sensing data. The output sensing data may be stored in a memory 220.

Further, the organic light emitting display device 100 according to the present exemplary embodiments may include a compensator 230 as a compensating configuration which compensates the subpixel characteristic deviation using a result (sensing data) sensed by the analog to digital converter 210 corresponding to the sensing configuration. The compensator 230 determines a compensation value which compensates the characteristic deviation of each sub pixel, based on the sensing data.

The compensator 230 may perform a process of changing data to be supplied to the sub pixel in accordance with a determined compensation value.

The compensator 230 may be included inside or outside of the timing controller 140.

The timing controller 140 transmits data DATA changed by the compensator 230 to a corresponding source driver integrated circuit of the data driver 120.

Therefore, a digital to analog converter DAC 240 in the source driver integrated circuit converts data received from the timing controller 140 into a data voltage VDATAi corresponding to an analog voltage value to supply the converted data voltage to the corresponding sub pixel.

As described above, when the analog to digital converter 210 is used, the compensator 230 may effectively figure out the characteristic of each sub pixel at a digital level.

The analog to digital converter 210 is implemented in the data driver 120 so that it is advantageous that there is no need to separately provide the sub pixel characteristic sensing configuration in the organic light emitting display panel 110 or the printed circuit board.

Hereinbelow, mobility compensation of the driving transistor DRT will be briefly described with reference to FIG. 3.

Referring to FIG. 3, in order to sense a mobility corresponding to a current capability characteristic excluding the threshold voltage Vth of the driving transistor DRT, the organic light emitting display device 100 applies the data voltage VDATAi to the first node N1 of the driving transistor DRT and applies a reference voltage VREF to the second node N2 of the driving transistor DRT, thereby initializing the first node N1 and the second node N2 of the driving transistor DRT.

In this case, the data voltage VDATAi which is applied to the first node N1 of the driving transistor DRT may be a data voltage VDATAs for mobility sensing.

The organic light emitting display device 100 floats both the first node N1 and the second node N2 of the driving transistor DRT after initializing the first node N1 and the second node N2 of the driving transistor DRT.

Therefore, voltages of the first node N1 and the second node N2 of the driving transistor DRT may rise.

While raising the voltages, the current flows to the sensing line SL via the driving transistor DRT and the second transistor SENT. Therefore, a line capacitor Cline on the sensing line is charged.

A voltage rising speed may vary depending on the current capability of the driving transistor DRT, that is, the mobility.

As described above, after the voltage rises for a predetermined time, the sensing line SL and the analog digital converter 210 are connected by the switch SW.

In this case, the analog digital converter 210 senses a voltage of the sensing line SL, that is, a voltage which is charged in the line capacitor Cline. The compensator 230 relatively figures out the current capability (that is, a mobility) of the driving transistor DRT, based on the sensing voltage Vsen. By doing this, a compensation gain for mobility compensation may be obtained.

The above-described mobility sensing may be performed at a predetermined timing. For example, the mobility sensing may be performed in real time by allocating a predetermined time (for example, a blank time period) while driving a screen.

Figure 4:
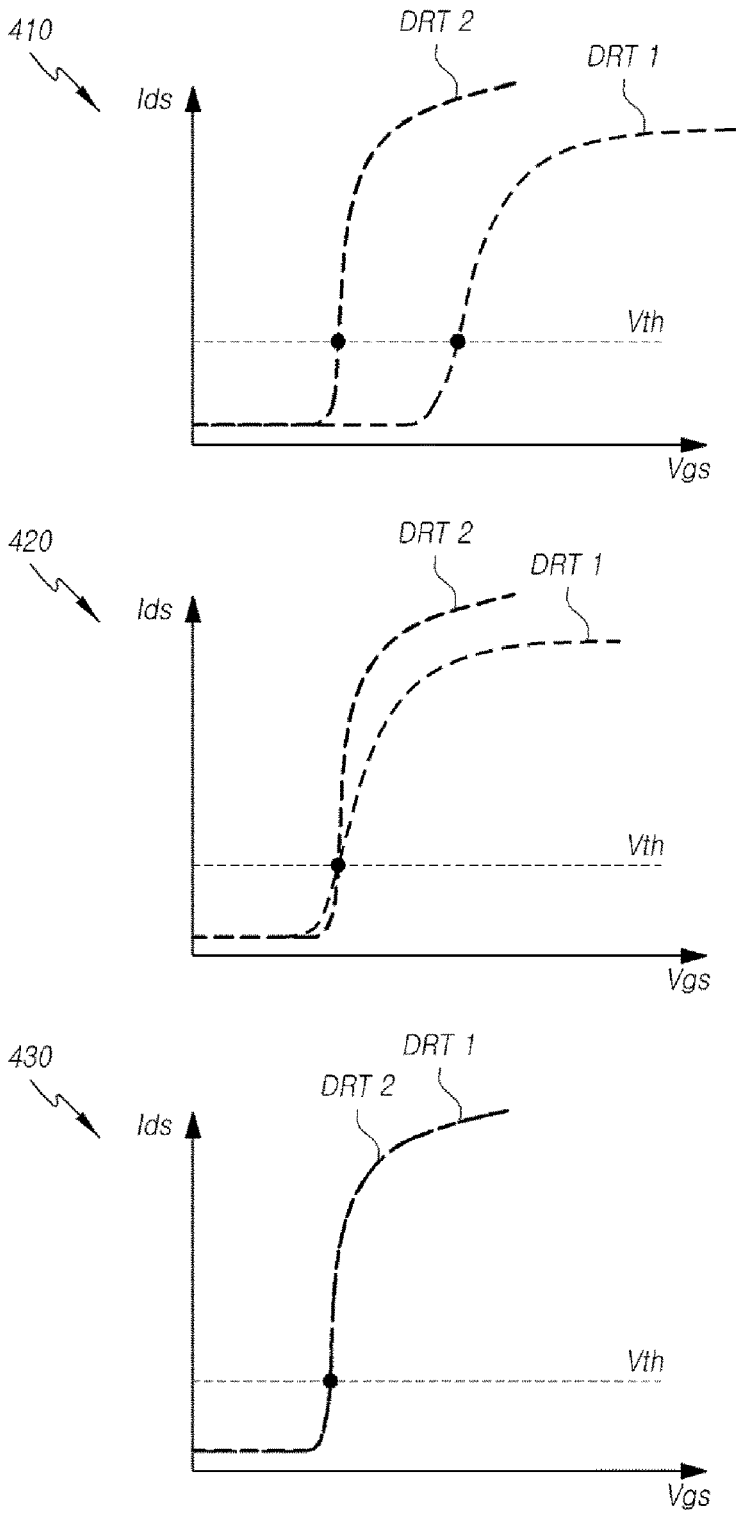
FIG. 4 is a view explaining a characteristic compensating concept of a driving transistor according to the present exemplary embodiments.

FIG. 4 is a view illustrating a characteristic compensating concept of the driving transistor DRT according to the present exemplary embodiments. FIG. 4 illustrates a graph 410 of Ids with respect to Vgs in accordance with a characteristic deviation of two driving transistors DRT1 and DRT2 included in two sub pixels, a graph 420 of Ids with respect to Vgs after compensating the threshold voltage deviation of two driving transistors DRT1 and DRT2, and a graph 430 of Ids with respect to Vgs after compensating the mobility after compensating the threshold voltage deviation of two driving transistors DRT1 and DRT2.

Referring to the graph 410 of FIG. 4 before performing the threshold voltage compensation and the mobility compensation, a time when a driving current flows to the organic light emitting diodes OLED in two sub pixels and a current amount may vary due to the threshold voltage deviation and the mobility deviation between two driving transistors DRT1 and DRT2. Therefore, brightness deviation is generated in two sub pixels, which may result in lowering the image quality.

Referring to the graph 420 of FIG. 4 after performing only the threshold voltage compensation, even though the threshold voltage deviation between two driving transistors DRT1 and DRT2 is reduced, a current capability difference between two driving transistors DRT1 and DRT2, that is, the mobility deviation is still present. Therefore, an amount of a driving current which flows into the organic light emitting diodes OLED in two sub pixels may vary. Therefore, brightness deviation is generated in two sub pixels, which may result in lowering the image quality.

Referring to the graph 430 of FIG. 4 after performing the threshold voltage compensation and the mobility compensation, both the threshold voltage deviation and the mobility deviation between two driving transistors DRT1 and DRT2 are reduced. Therefore, brightness deviation in two sub pixels is significantly reduced so that the image quality may be improved.

Figure 5:
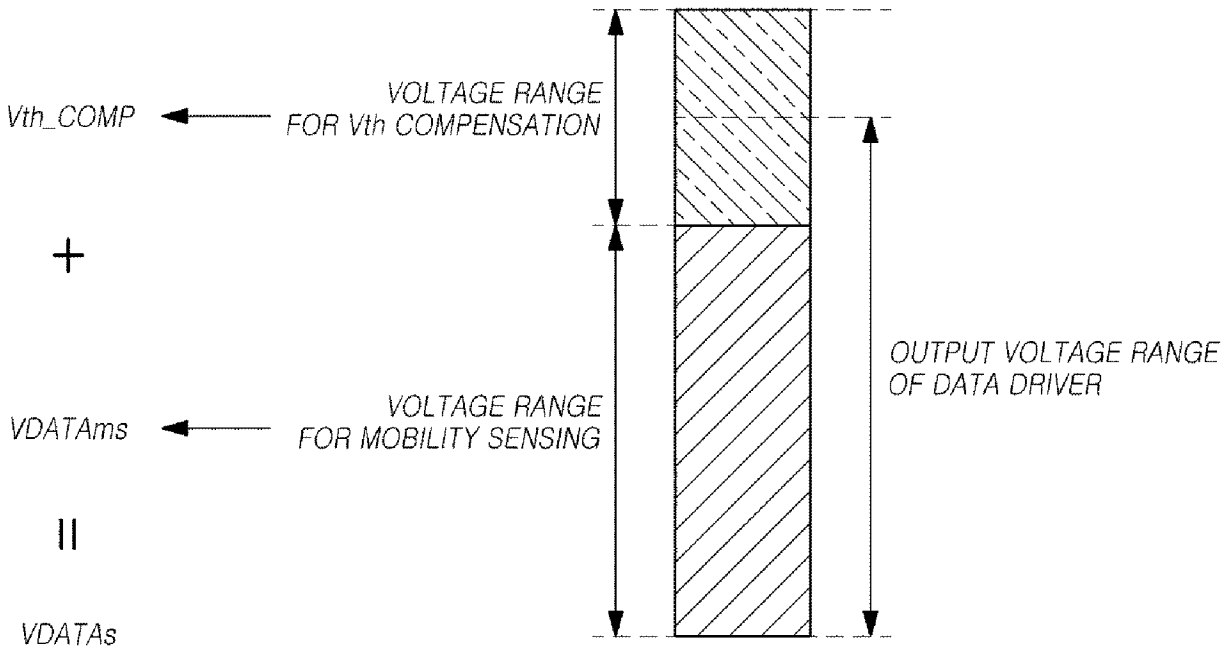
FIG. 5 is a view illustrating components and individual voltage ranges of a data voltage for mobility sensing according to the present exemplary embodiments.
Figure 6:
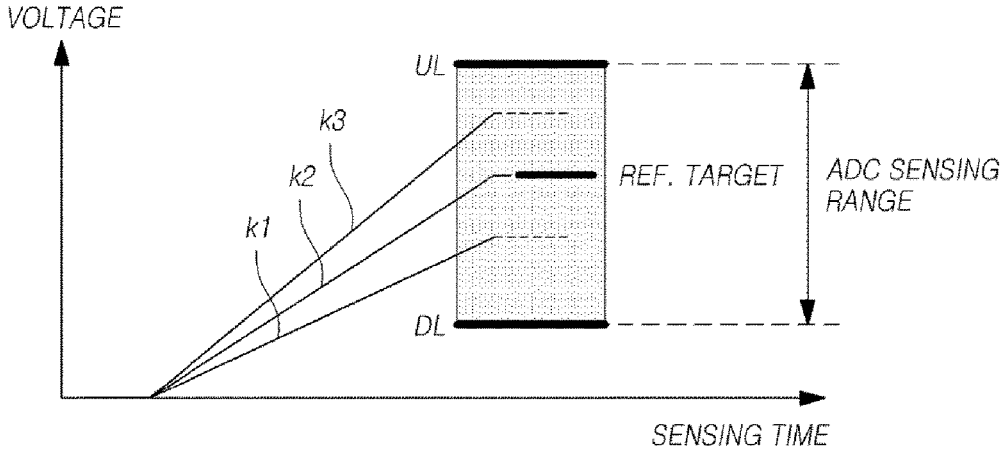
FIG. 6 is a view illustrating a change in voltages of a sensing line in accordance with a sensing time when mobility sensing according to the present exemplary embodiments is performed.
Figure 7:
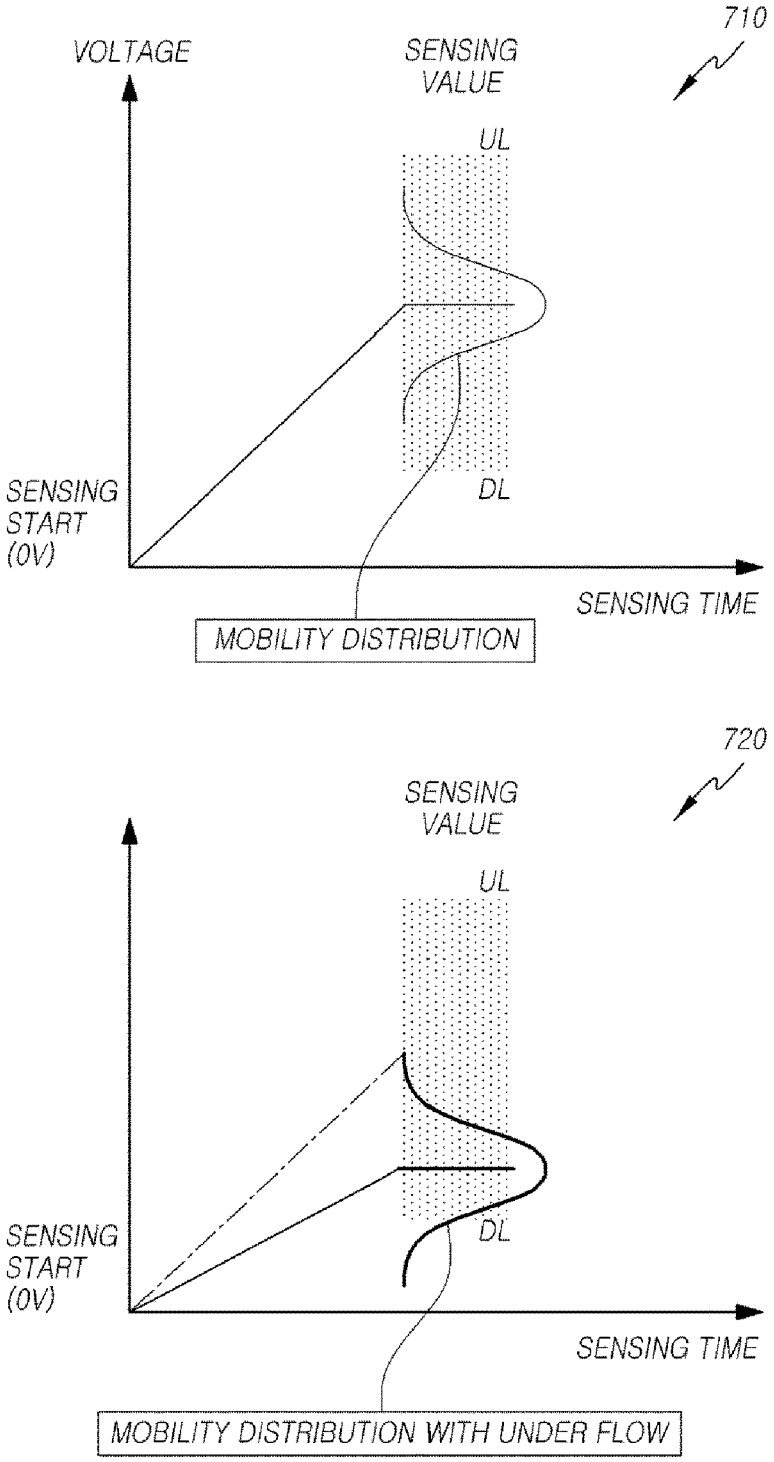
FIGS. 7 and 8 are exemplary views of a change in voltages of a sensing line in accordance with a sensing time when mobility sensing according to the present exemplary embodiments is performed.
Figure 8:
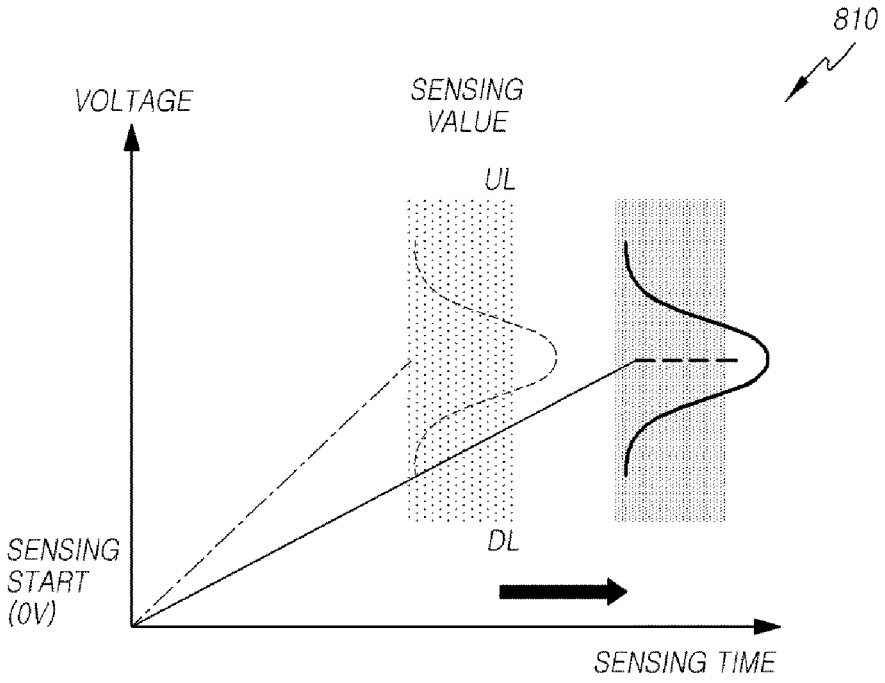
Figure 8:
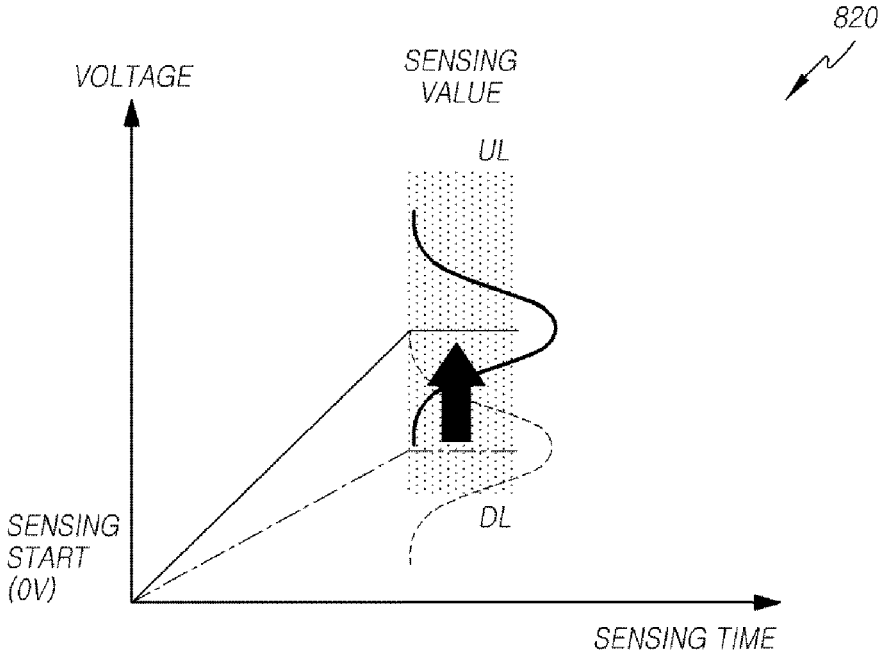

FIG. 5 is a view illustrating components and individual voltage ranges of a data voltage VDATAs for mobility sensing according to the present exemplary embodiments. FIG. 6 is a view illustrating a change in voltages of a sensing line SL in accordance with a sensing time when mobility sensing according to the present exemplary embodiments is performed. FIGS. 7 and 8 are exemplary views of a change in voltages of a sensing line SL in accordance with a sensing time when mobility sensing according to the present exemplary embodiments is performed.

Referring to FIG. 5, when the mobility sensing is performed, a data voltage VDATAs for mobility sensing needs to be applied to the first node N1 of the driving transistor DRT.

To this end, a corresponding source driver integrated circuit of the data driver 120 outputs the data voltage VDATAs for mobility sensing.

Each source driver integrated circuit included in the data driver 120 converts data received from the timing controller 120 into a data voltage corresponding to an analog voltage value and outputs the converted data voltage. In this case, the data voltage which is converted and output is a data voltage VDATAs for mobility sensing.

When the mobility sensing is performed, the data voltage VDATAs for mobility sensing may be output within an output voltage range of each source driver integrated circuit.

When the mobility sensing is performed, the data voltage VDATAs which is output from each source driver integrated circuit has a voltage component VDATAms for mobility sensing and a voltage component Vth_COMP for threshold voltage compensation.

That is, when the mobility sensing is performed, a data voltage VDATAs which is applied to the first node N1 of the driving transistor DRT may be represented by the following Equation 1.

$$V\text{DATAs}=V\text{DATAms}+V\text{th_COMP} \quad \text{Equation 1}$$

As represented in Equation 1, when the mobility sensing is performed, the data voltage VDATAs which is output from each source driver integrated circuit has the voltage component VDATAms for mobility sensing and the voltage component Vth_COMP for threshold voltage compensation. This is because the timing controller 140 outputs data obtained by adding a compensation value for threshold voltage compensation to data for mobility sensing to the data driver 120.

In the meantime, the threshold voltage sensing and compensation may be performed before or after mobility sensing. If the threshold voltage sensing and compensation are performed before mobility sensing, when the mobility sensing is performed, the data voltage VDATAs output from each source driver integrated circuit includes the voltage component Vth_COMP for threshold voltage compensation.

In the meantime, referring to FIG. 6, with respect to the corresponding sub pixel in the organic light emitting display panel 110, the analog digital converter 210 senses a voltage of the sensing line SL to convert a sensed voltage value into a digital value.

In this case, the analog to digital converter 210 has a conversion range (that is, an ADC sensing range defined by a lower limit DL and an upper limit UL) of the digital value with respect to an analog voltage value.

In a voltage change graph of the sensing line SL with respect to the sensing time illustrated in FIG. 6, slopes k1, k2, and k3 indicating that a voltage of the sensing line SL is increased as the sensing time is increased may vary depending on the current capability of each driving transistor DRT.

A driving transistor DRT in which the voltage of the sensing line SL is increased with a largest slope k3 has the highest current capability (mobility). A driving transistor DRT in which the voltage of the sensing line SL is increased with a smallest slope k1 has the lowest current capability (mobility).

When a voltage Vsen which is actually sensed is higher or lower than a target sensing voltage REF.TARGET for removing or reducing the mobility deviation between the driving transistors DRT after the voltage of the sensing line SL is changed for a predetermined time, the mobility may be compensated so that the sensing voltage becomes a target sensing voltage REF.TARGET.

In the meantime, in order to precisely compensate the mobility, a distribution (mobility distribution) of the sensing voltage values for all sub pixels needs to be included within an ADC sensing range, as illustrated in the first graph 710 of FIG. 7.

If the distribution (mobility distribution) of the sensing voltage values for all sub pixels is not included within the ADC sensing range, as illustrated in the second graph 720, when the mobility distribution has the mobility distribution with under flow, wrong sensing result is obtained. Therefore, the mobility compensation may not be satisfactorily performed.

As illustrated in the second graph 720 of FIG. 7, when the mobility distribution for all sub pixels in the organic light emitting display panel 110 is a mobility distribution with under flow, there may be a driving transistor DRT having a low current capability and mobility.

A situation where the current capability of the driving transistor DRT is insufficient is caused because a sub pixel size is reduced for high resolution of the organic light emitting display device 100 and a size of the driving transistor DRT is reduced to increase the aperture ratio.

Therefore, in order to change the mobility distribution for all sub pixels in the organic light emitting display panel 110 from the mobility distribution with under flow as illustrated in the second graph 720 of FIG. 7 into a normal mobility distribution as illustrated in the first graph 710 of FIG. 7 without increasing a size of the driving transistor DRT, there may be a method for increasing a sensing time as illustrated in a first graph 810 of FIG. 8 or a method for increasing a current amount (a method for increasing a bias voltage Vgs of the driving transistor DRT) as illustrated in a second graph 820 of FIG. 8.

However, the method for increasing a sensing time as illustrated in the first graph 810 of FIG. 8 is not available due to a sensible time limit when the mobility sensing is performed in a real time while driving an image.

Further, in the case of the method (a method for increasing a bias voltage Vgs of the driving transistor DRT) for increasing a current amount as illustrated in the second graph 820 of FIG. 8, each source driver integrated circuit needs to output a higher data voltage VDATAs. However, in this case, there may be a limitation to increase a capability (that is, an output voltage range) of the source driver integrated circuit of the data driver 120.

Therefore, in order to reduce a size of the sub pixel and increase the aperture ratio to obtain a high resolution of the organic light emitting display device 100, the driving transistor DRT is designed to have a small size. Therefore, in a situation where the current capability of the driving transistor DRT is insufficient, it is desperately required to precisely perform mobility compensation using a low data voltage VDATAs for mobility sensing for a short sensing time.

Therefore, the present exemplary embodiments provides an organic light emitting display panel 110, an organic light emitting display device 100, an a driving method thereof which may precisely perform mobility compensation using a low data voltage VDATAs for mobility sensing for a short sensing time in a situation where the current capability of the driving transistor DRT is insufficient.

In the meantime, a plurality of sensing lines disposed in the organic light emitting display panel 110 according to the exemplary embodiments may be disposed for every one sub pixel column or every two or more sub pixel columns.

In other words, one sensing line SL may be disposed for every sub pixel column or one sensing line SL may be disposed for every two or more sub pixel columns.

When one sensing line SL is disposed for every two or more sub pixel column, if the sensing line arrangement unit is K (K≥2), it is understood that the plurality of sensing lines is disposed for every K sub pixel columns.

Figure 9:
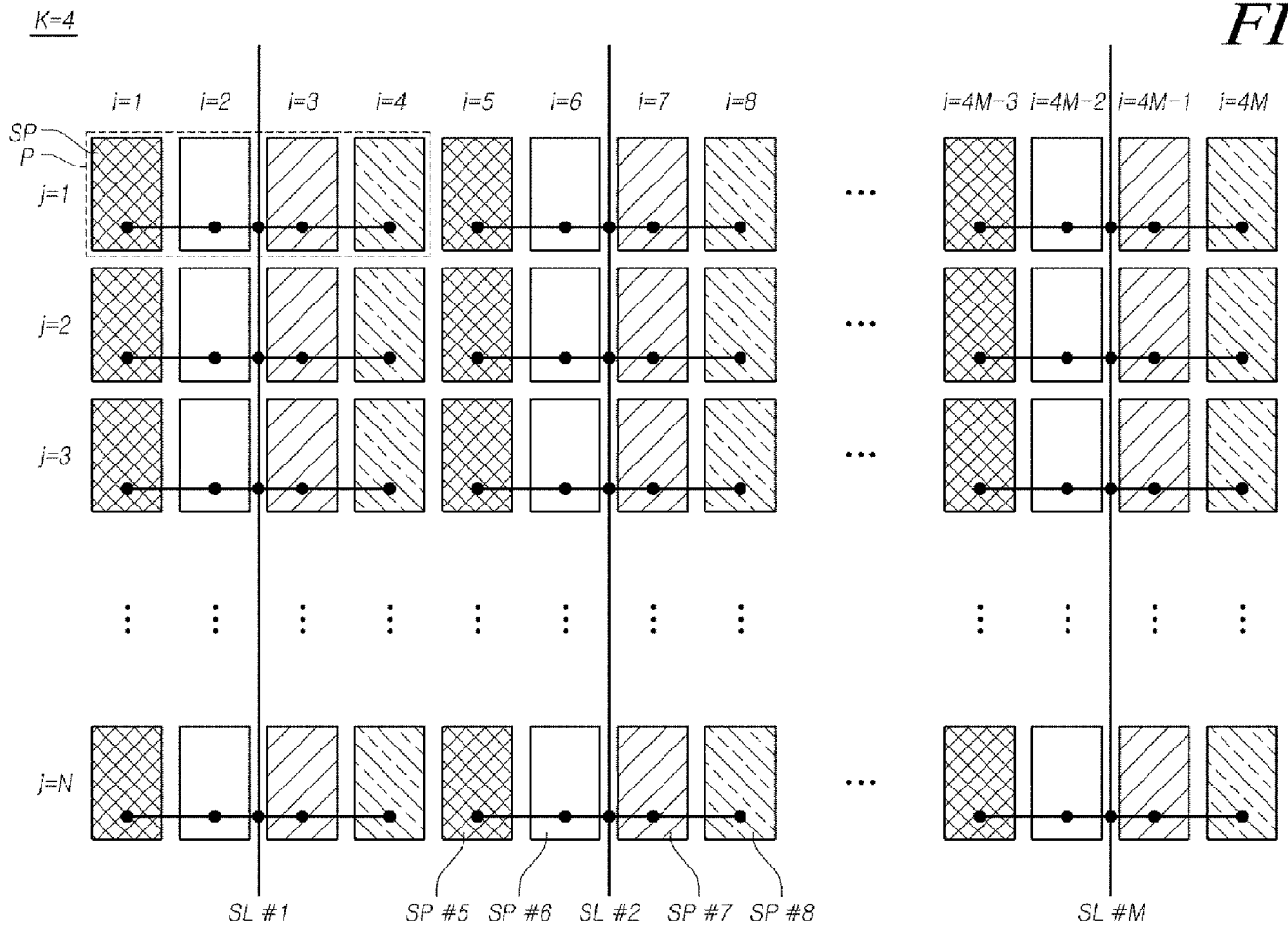
FIG. 9 is an exemplary view of a sensing line arrangement in an organic light emitting display panel according to the present exemplary embodiments.

FIG. 9 is an exemplary view of an arrangement of the sensing line in the organic light emitting display panel 110 according to the exemplary embodiments. As illustrated in FIG. 1, when there are 4M sub pixel columns in the organic light emitting display panel 110, one sensing line is disposed for every four sub pixel columns.

In other words, FIG. 9 is an arrangement view illustrating that when the sensing line arrangement unit K is 4, M (=4M/K=4M/4=M) sensing lines SL #1, SL #2, . . . , SL #M are disposed every four sub pixel columns.

As described above, it is understood that when M sensing lines SL #1, SL #2, . . . , SL #M are disposed for every four sub pixel columns, M sensing lines SL #1, SL #2, . . . , SL #M is disposed for every pixel column under a pixel structure in which one pixel P may be configured by four sub pixels SP.

In this case, as seen from one sub pixel row, one sensing line is commonly connected to four sub pixels.

For example, a sensing line SL #2 is commonly connected to a sub pixel SP #5 in which i=5, a sub pixel SP #6 in which i=6, a sub pixel SP #7 in which i=7, and a sub pixel SP #8 in which i=8.

A mobility sensing method according to the present exemplary embodiment will be described below under an assumption that K=4, that is, M sensing lines SL #1, SL #2, . . . , SL #M are disposed for every four sub pixel columns.

Figure 10:
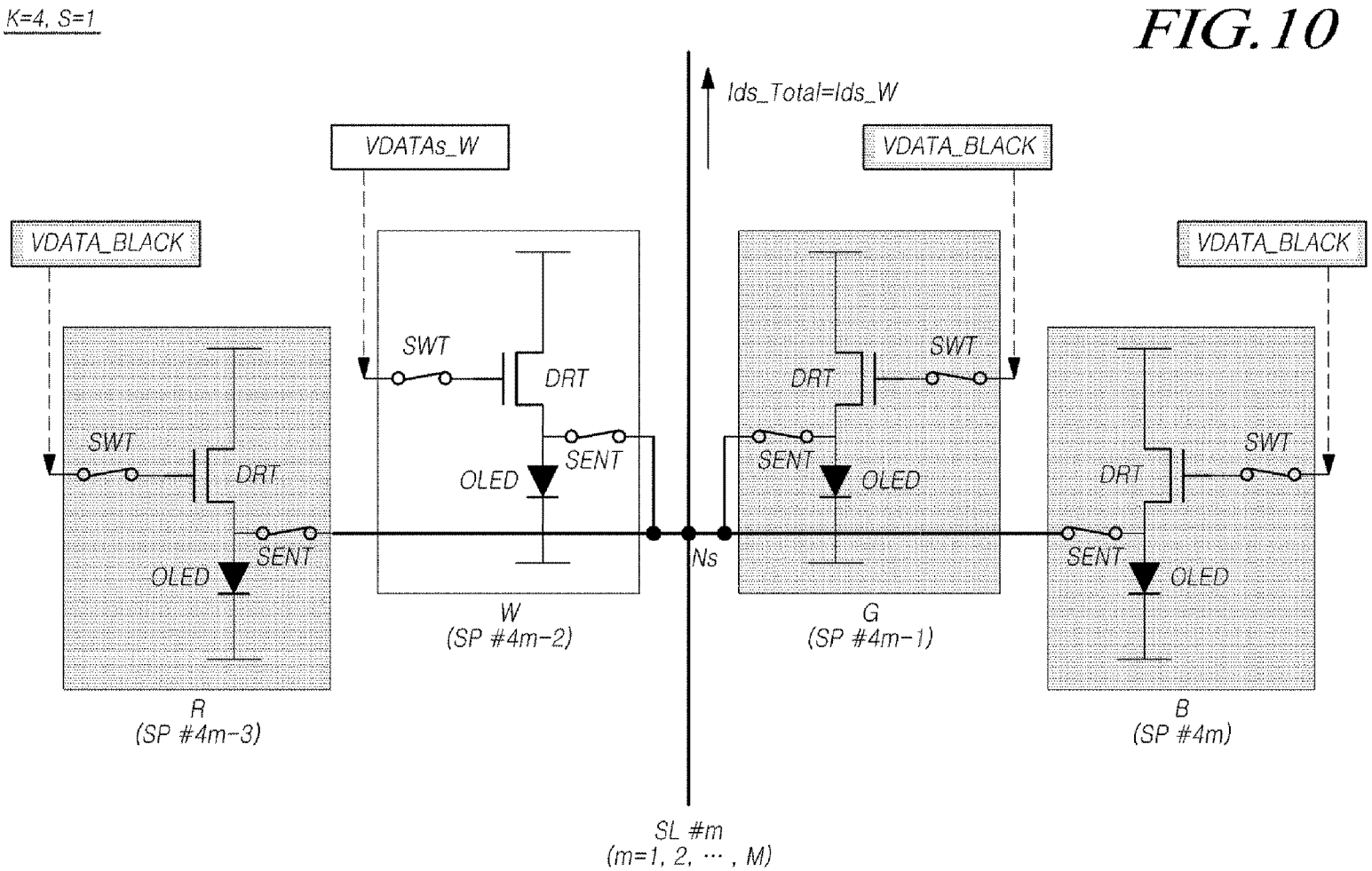
FIG. 10 is a view illustrating a method for sensing only one sub pixel among four sub pixels commonly connected to one sensing line when mobility sensing according to the present exemplary embodiments is performed.

FIG. 10 is a view illustrating a method for sensing only one sub pixel among four sub pixels R(SP #4m−3), W(SP #4m−2), G(SP #4m−1), B(SP #4m commonly connected to one arbitrary sensing line SL #m, m−1, 2, . . . , M when mobility sensing according to the present exemplary embodiments is performed.

Here, K sub pixels (in FIG. 10, R, W, G, and B) which are commonly connected to one sensing line SL #m may configure one pixel.

Referring to FIG. 10, one arbitrary sensing line SL #m (m=1, 2, . . . , M) is commonly connected to four sub pixels R(SP #4m−3), W(SP #4m−2), G(SP #4m−1) and B(SP #4m.

More specifically, one arbitrary sensing line SL #m (m=1, 2 . . . , M) is commonly connected second transistors SENT in four sub pixels R, W, G, and B at a sensing node Ns.

Referring to FIG. 10, when mobility sensing is performed, only one sub pixel among four sub pixels R(SP #4m−3), W(SP #4m−2), G(SP #4m−1), and B(SP #4m which are commonly connected to one arbitrary sensing line SL #m is sensed.

FIG. 10 is a view illustrating that mobility sensing is performed only in a W sub pixel among four sub pixels R(SP #4m−3), W(SP #4m−2), G(SP #4m−1), and B(SP #4m which are commonly connected to one sensing line SL #m.

In this case, a data voltage VDATAs_W for mobility sensing is applied to a first node N1 of a driving transistor DRT of the W sub pixel among four sub pixels R(SP #4m−3), W(SP #4m−2), G(SP #4m−1), and B(SP #4m which are commonly connected to one sensing line SL #m.

However, not a data voltage VDATAs for sensing (for example, for mobility sensing or for threshold voltage sensing), but a black data voltage VDATA_BLACK is applied to a first node N1 of each of driving transistors DRT of a R sub pixel, a G sub pixel, and a B sub pixel in which mobility sensing is not performed, among four sub pixels R(SP#4m−3), W(SP#4m−2), G(SP#4m−1), and B(SP #4m which are commonly connected to one sensing line SL #m. Here, the black data voltage VDATA_BLACK may have a predetermined voltage value, for example, a voltage of 0 V. in some cases, the black data voltage VDATA_BLACK may have a voltage value (for example, −0.5 V or −1 V) which is lower than 0 V or a voltage value (for example, 0.5 V or 1 V) which is higher than 0 V.

In this case, a total current Ids_Total which flows into the sensing line SL #m for mobility sensing is equal to a current Ids_W which flows into the W sub pixel in which mobility sensing is performed.

When it is assumed that the number of sub pixels in which mobility sensing is performed simultaneously, among four sub pixels R, W, G, and B which are commonly connected to one sensing line SL #m is S, S=1 in FIG. 10.

As described above, only one sub pixel among four sub pixels R, W, G, and B which are commonly connected to one sensing line SL #m is sensed, if the current capability (mobility) of the driving transistor DRT in each subpixel is insufficient, the current amount of the total current Ids_Total which flows into the sensing line SL #m is insufficient. Therefore, the mobility is not precisely sensed and thus the mobility is not sufficiently compensated.

Figure 11:
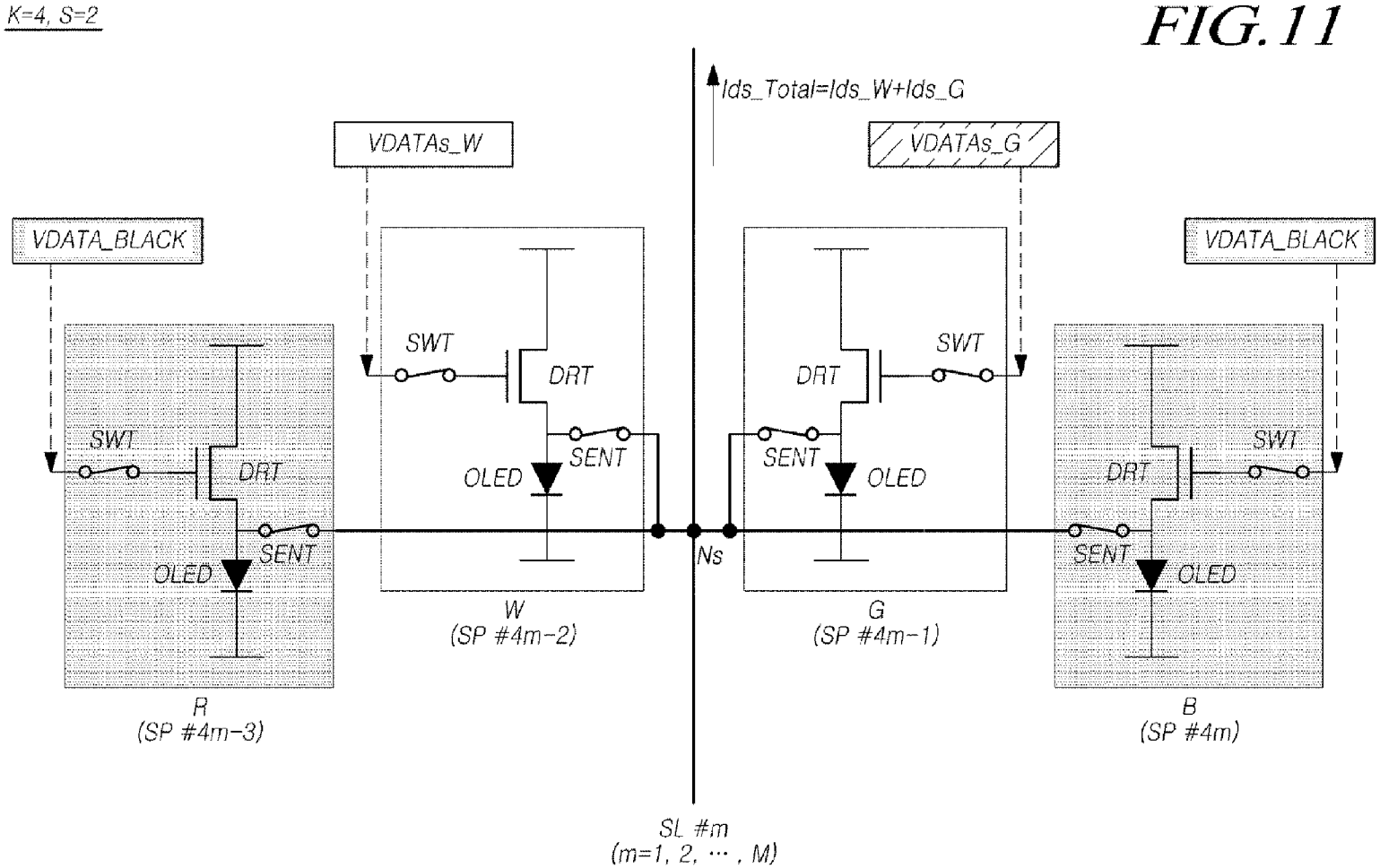
FIG. 11 is a view illustrating a method for simultaneously sensing two sub pixels among four sub pixels commonly connected to one sensing line when mobility sensing according to the present exemplary embodiments is performed.
Figure 12:
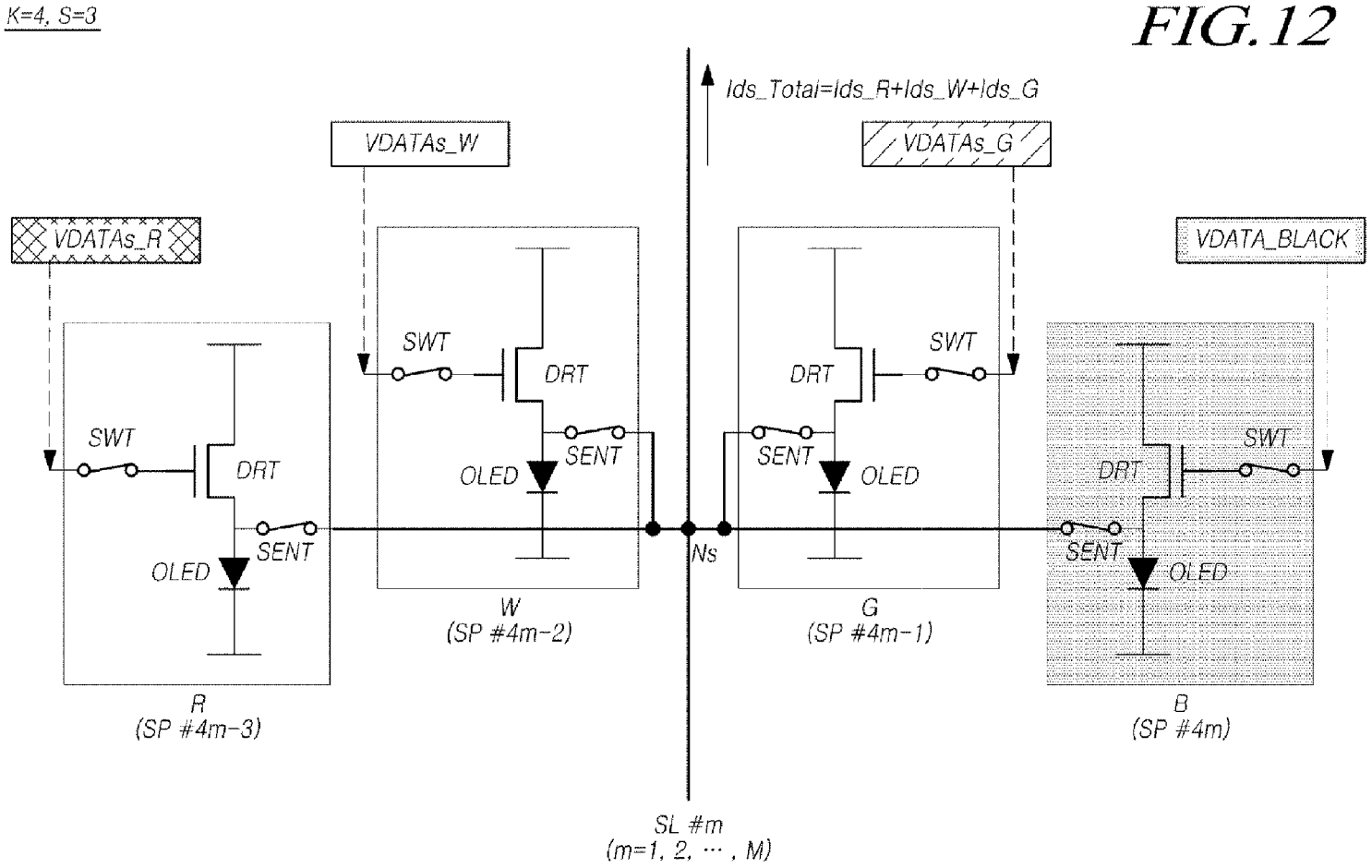
FIG. 12 is a view illustrating a method for simultaneously sensing three sub pixels among four sub pixels commonly connected to one sensing line when mobility sensing according to the present exemplary embodiments is performed.
Figure 13:
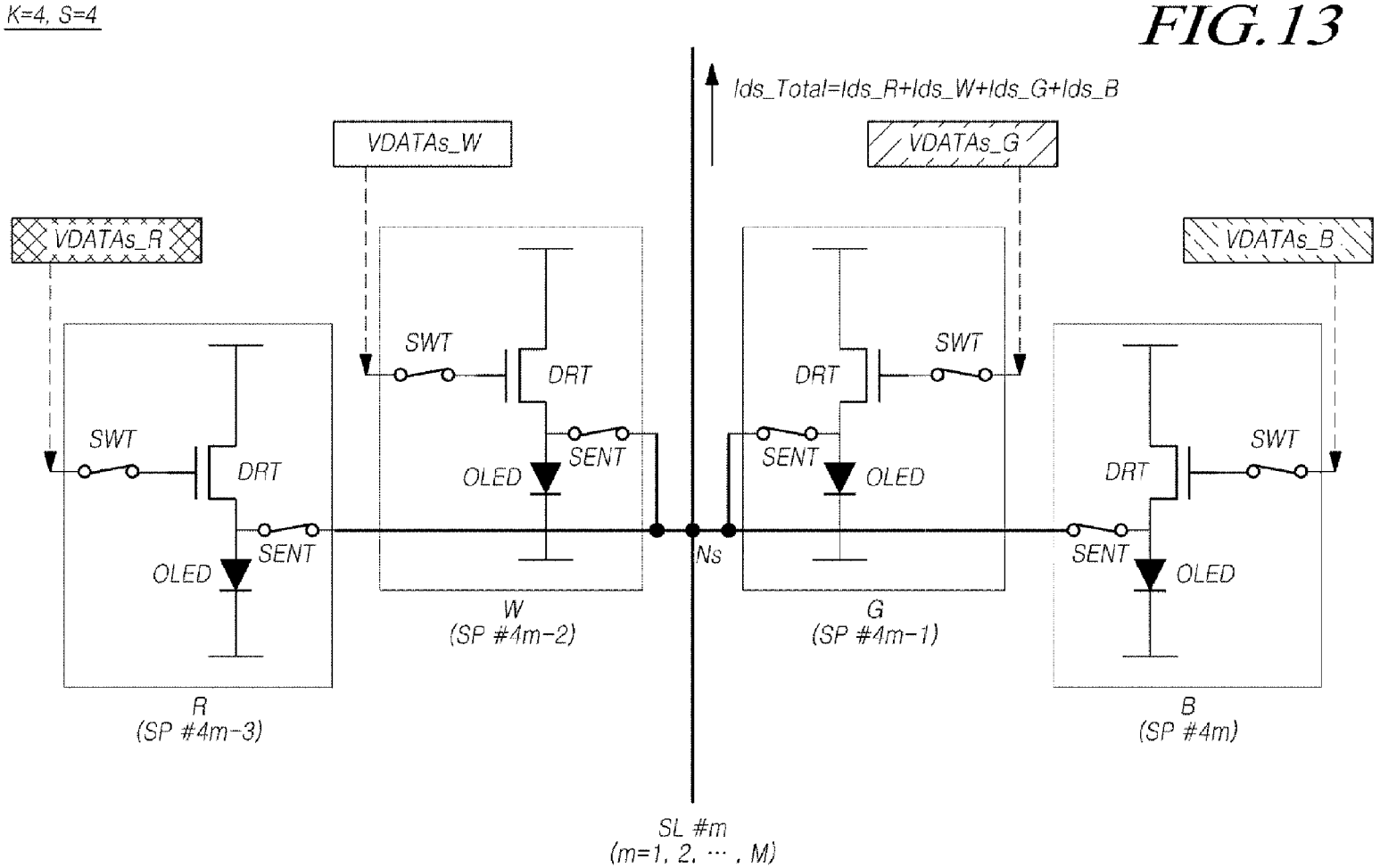
FIG. 13 is a view illustrating a method for simultaneously sensing four sub pixels among four sub pixels commonly connected to one sensing line when mobility sensing according to the present exemplary embodiments is performed.

Therefore, the organic light emitting display device 100 according to the present, as illustrated in FIGS. 11 to 13, may simultaneously sense the mobility of two or more sub pixels among four sub pixels R, W, G, and B which are commonly connected to one sensing line SL #m. That is, the number S of sub pixels in which the mobility sensing is simultaneously performed may be 2 or more and K or less (2≤S≤K).

FIG. 11 is a view illustrating a method for simultaneously sensing two sub pixels W and G among four sub pixels R, W, G, and B commonly connected to one sensing line SL #m when mobility sensing according to the present exemplary embodiments is performed (K=4, S=2). FIG. 12 is a view illustrating a method for simultaneously sensing three sub pixels R, W and G among four sub pixels R, W, G, and B commonly connected to one sensing line SL #m when mobility sensing according to the present exemplary embodiments is performed (K=4, S=3). FIG. 13 is a view illustrating a method for simultaneously sensing four sub pixels R, W, G, and B among four sub pixels R, W, G, and B commonly connected to one sensing line SL #m when mobility sensing according to the present exemplary embodiments is performed (K=4, S=4).

Referring to FIGS. 11 to 13, S sub pixels (two sub pixels G and B in FIG. 11, three sub pixels R, G, and B in FIG. 12, and four sub pixels R, W, G, and B in FIG. 13) are selected as sub pixels which are simultaneously sensed, among K sub pixels which are commonly connected to the sensing line SL #m.

Referring to FIGS. 11 to 13, in the organic light emitting display device 100 according to the exemplary embodiments, when a characteristic of the driving transistor is measured, that is, a sensing operation is performed, a driving transistor DRT in each of S sub pixels (if 2≤S≤K and K=4, S=2, or 3, or 4) among K (K=4) sub pixels which are commonly connected to each sensing line SL #m in one sub pixel row may be simultaneously applied with not a black data voltage VDATA_BLACK, but a sensing data voltage VDATAs through the first node N1.

To this end, when the characteristic of the driving transistor is measured, the data driver 120 may output a sensing data voltage to a data line which is connected to each of S sub pixels (if 2≤S≤K and K=4S=2, or 3, or 4) among K (K=4) sub pixels which are commonly connected to each sensing line SL #m.

The data driver may output a predetermined black data voltage to a data line which is connected to K−S sub pixels as a non-sensing data voltage, while outputting a sensing data voltage to the data line which is connected to each of S (if 2≤S≤K and K=4, S=2, or 3, or 4) sub pixels.

In other words, the data driver 120 may output a sensing data voltage to S data lines among K data lines corresponding to one sensing line SL # m and output a predetermined black data voltage which is defined as a non-sensing data voltage, to K−S data lines excluding S data lines to which sensing data voltage is output from K data lines, while measuring the characteristic of the driving transistor.

Here, the S sub pixels connected to S data lines are selected, as sub pixels which are simultaneously sensed, from K sub pixels which are connected to K data lines corresponding to one sensing line.

The sub pixel to be sensed may be selected by the timing controller 140.

That is, the timing controller 140 selects S sub pixels which will be simultaneously sensed, from K sub pixels which are commonly connected to one sensing line and makes data corresponding to selected S sub pixels as sensing data such that the sensing data voltage is supplied to the selected S sub pixel. The timing controller 140 supplies the sensing data to the data driver 120.

Further, the timing controller 140 makes data corresponding to K−S sub pixels as non-sensing data (for example, a black data voltage) such that the non-sensing data voltage is supplied to K−S sub pixels which are not sensed, among K sub pixels which are commonly connected to one sensing line. The timing controller 140 supplies the non-sensing data to the data driver 120.

Here, the sensing data voltage VDATAs may be a data voltage for mobility sensing or a data voltage for threshold voltage sensing. However, for the convenience of description, the sensing data voltage VDATAs is also referred to as a data voltage for mobility sensing, hereinbelow.

Here, when the sensing data voltage VDATAs is "simultaneously" applied to the first node N1 of the driving transistor DRT in each of S sub pixels, timings when the sensing data voltage VDATAs is applied to the first nodes N1 of the driving transistors in S sub pixels may be perfectly same. However, substantially, the applying timings may be slightly different. With regard to this, when the sensing data voltage VDATAs is "simultaneously" applied to the first node N1 of the driving transistor DRT in each of S sub pixels, it means that the sensing data voltage VDATAs is applied to the first node N1 of the driving transistor DRT in each of S sub pixels in one-time sensing period for one-time voltage sensing of the analog to digital converter 210.

Referring to FIG. 11, when S=2, a data voltage VDATAs_W for mobility sensing is applied to the first node N1 of the driving transistor DRT in the W sub pixel and a data voltage VDATAs_G for mobility sensing is applied to a first node N1 of a driving transistor DRT in the G sub pixel in which mobility sensing is performed simultaneously with the W sub pixel.

In this case, a current amount of total current Ids_Total which flows into the sensing line SL #m is equal to a sum of current amounts of a current Ids_W which flows through the driving transistor DRT in the W sub pixel and a current Ids_G which flows through the driving transistor DRT in the G sub pixel.

In this case, a current capability (mobility) of the driving transistor DRT in each of the W sub pixel and the G sub pixel may be considered to be half the current amount of the total current Ids_Total which flows into the sensing line SL #m.

That is, the current capability (mobility) of the driving transistor DRT in each of the W sub pixel and the G subpixel corresponds to half the current capability (mobility) obtained based on the sensing voltage Vsen of the sensing line SL #m. Therefore, a gain for mobility compensation may be determined in accordance with this.

On the contrary, the current capability (mobility) of the driving transistor DRT in each of the W sub pixel and the G sub pixel may proportionally divide the current amount of the total current Ids_Total which flows into the sensing line SL #m in accordance with a proportion of a size W/L or a channel width W of the driving transistor in each of the W sub pixel and the G sub pixel.

That is, the current capability (mobility) of the driving transistor DRT in each of the W sub pixel and the G sub pixel may be obtained by proportionally dividing a current capability (mobility) obtained based on the sensing voltage Vsen of the sensing line SL #m in accordance with a proportion of a size W/L or a channel width W of the driving transistor in each of the W sub pixel and the G sub pixel. The gain for mobility compensation may be determined in accordance with this.

As illustrated in FIG. 11, when mobility is simultaneously sensed in two sub pixels, a problem caused by an insufficient current amount is solved as compared with a case that mobility sensing is performed only in one sub pixel. Therefore, a problem in that the mobility sensing and mobility compensation are not satisfactorily performed due to insufficient current may be solved.

Referring to FIG. 12, when S=3, a data voltage VDATAs R for mobility sensing is applied to a first node N1 of a driving transistor DRT in a R subpixel, a data voltage VDATAs_W for mobility sensing is applied to the first node N1 of the driving transistor DRT in the W sub pixel and a data voltage VDATAs_G for mobility sensing is applied to the first node N1 of the driving transistor DRT in the G sub pixel.

In this case, a current amount of total current Ids_Total which flows into the sensing line SL #m is equal to a sum of current amounts of a current Ids_R which flows through the driving transistor DRT in the R sub pixel, the current Ids_W which flows through the driving transistor DRT in the W sub pixel, and the current Ids_G which flows through the driving transistor DRT in the G sub pixel.

In this case, a current capability (mobility) of the driving transistor DRT in each of the R sub pixel, the W sub pixel, and the G sub pixel may be considered to be one third of the current amount of the total current Ids_Total which flows into the sensing line SL #m.

That is, the current capability (mobility) of the driving transistor DRT in each of the R sub pixel, the W sub pixel, and the G sub pixel corresponds to one third of the current capability (mobility) obtained based on the sensing voltage Vsen of the sensing line SL #m. Therefore, a gain for mobility compensation may be determined in accordance with this.

On the contrary, the current capability (mobility) of the driving transistor DRT in each of the R sub pixel, the W sub pixel, and the G sub pixel may proportionally divide the current amount of the total current Ids_Total which flows into the sensing line SL #m in accordance with a proportion of a size W/L or a channel width W of the driving transistor in each of the R sub pixel, the W sub pixel, and the G sub pixel.

That is, the current capability (mobility) of the driving transistor DRT in each of the R sub pixel, the W sub pixel, and the G sub pixel may be obtained by proportionally dividing a current capability (mobility) obtained based on the sensing voltage Vsen of the sensing line SL #m in accordance with a proportion of a size W/L or a channel width W of the driving transistor in each of the R sub pixel, the W sub pixel, and the G sub pixel. The gain for mobility compensation may be determined in accordance with this.

As illustrated in FIG. 12, when mobility is simultaneously sensed in three sub pixels, a problem caused by an insufficient current amount is solved as compared with a case that mobility sensing is performed only in one sub pixel and mobility sensing is simultaneously performed in two sub pixels. Therefore, a problem in that the mobility sensing and mobility compensation are not satisfactorily performed due to insufficient current may be solved.

Referring to FIG. 13, when S=3, a data voltage VDATAs R for mobility sensing is applied to a first node N1 of a driving transistor DRT in a R sub pixel, a data voltage VDATAs_W for mobility sensing is applied to the first node N1 of the driving transistor DRT in the W sub pixel, a data voltage VDATAs_G for mobility sensing is applied to the first node N1 of the driving transistor DRT in the G sub pixel, and a data voltage VDATAs B for mobility sensing is applied to a first node N1 of a driving transistor DRT in a B sub pixel.

In this case, a current amount of total current Ids_Total which flows into the sensing line SL #m is equal to a sum of current amounts of the current Ids_R which flows through the driving transistor DRT in the R sub pixel, the current Ids_W which flows through the driving transistor DRT in the W sub pixel, the current Ids_G which flows through the driving transistor DRT in the G sub pixel, and a current Ids_B which flows through the driving transistor DRT in the B sub pixel.

In this case, a current capability (mobility) of the driving transistor DRT in each of the R sub pixel, the W sub pixel, the G sub pixel, and the B sub pixel is considered to be one fourth of the current amount of the total current Ids_Total which flows into the sensing line SL #m.

That is, the current capability (mobility) of the driving transistor DRT in each of the R sub pixel, the W sub pixel, the G sub pixel, and the B sub pixel corresponds to one fourth of the current capability (mobility) obtained based on the sensing voltage Vsen of the sensing line SL #m. Therefore, a gain for mobility compensation may be determined in accordance with this.

On the contrary, the current capability (mobility) of the driving transistor DRT in each of the R sub pixel, the W sub pixel, the G sub pixel, and the B sub pixel may proportionally divide the current amount of the total current Ids_Total which flows into the sensing line SL #m in accordance with a proportion of a size W/L or a channel width W of the driving transistor in each of the R sub pixel, the W sub pixel, the G sub pixel, the B sub pixel.

That is, the current capability (mobility) of the driving transistor DRT in each of the R sub pixel, the W sub pixel, the G sub pixel, and the B sub pixel may be obtained by proportionally dividing a current capability (mobility) obtained based on the sensing voltage Vsen of the sensing line SL #m in accordance with a proportion of a size W/L or a channel width W of the driving transistor in each of the R sub pixel, the W sub pixel, the G sub pixel, and the B subpixel. The gain for mobility compensation may be determined in accordance with this.

As illustrated in FIG. 13, when mobility is simultaneously sensed in four sub pixels, a problem caused by an insufficient current amount is solved as compared with a case that mobility sensing is performed only in one sub pixel and mobility sensing is simultaneously performed in two and three sub pixels. Therefore, a problem in that the mobility sensing and mobility compensation are not satisfactorily performed due to insufficient current may be solved.

As described above, the total current Ids_Total which flows in each sensing line SL # m corresponds to a sum of currents which are electrically conducted in the driving transistor DRT in each of S sub pixels (R, W, G, and B when S=4) commonly connected to each sensing line SL # m.

In other words, the current Ids_Total which flows into one sensing line corresponding to K data lines corresponds to a sum of current which flows through the driving transistor DRT in each of S sub pixels (R, W, G, and B when S=4) commonly connected to each sensing line SL # m to which a sensing data voltage is output, among K sub pixels which are connected to K data lines and also commonly connected to one sensing line.

As illustrated in FIGS. 11 to 13, when mobility sensing is performed simultaneously in two or more sub pixels, among four sub pixels R, W, G, and B which are commonly connected to one sensing line S1 # m, the current insufficiency due to insufficiency of the current capability of the driving transistor DRT in each sub pixel may be suppressed. Therefore, even though a size of the sub pixel is reduced for a high resolution of the organic light emitting display device 100 and the driving transistor DRT is designed to have a small size for an increased aperture ratio, the mobility sensing and compensation may be precisely performed using a sensing data voltage VDATAs having a low mobility for a short sensing time.

In addition to the S sub pixels in which the mobility sensing is simultaneously performed, when there are K−S sub pixels (R and B sub pixels in FIG. 11 in which K=4 and S=2, and B sub pixel in FIG. 12 in which K=4 and S=3) which are commonly connected to a plurality of sensing lines, a driving transistor DRT in each of the K−S sub pixels are applied with the black data voltage VDATA_BLACK through the first node N1 while not the black data voltage VDATA_BLACK, but the data voltage VDATAs is applied to the first node N1 of the driving transistor DRT in each of the S sub pixels (W and G sub pixels in FIG. 11 in which K=4 and S=2, and R, W, and G sub pixel in FIG. 12 in which K=4 and S=3).

As described above, the mobility sensing is performed simultaneously in some sub pixels among K sub pixels commonly connected to one sensing line SL #m, but the mobility sensing is not performed in the remaining sub pixel(s), so that a load in accordance with the mobility sensing is optimized and reduced.

However, as described above, the mobility sensing is performed simultaneously in two or more sub pixels among K sub pixels R, W, G, and B commonly connected to one sensing line SL #m so that individual current capability of the driving transistors DRT are not reflected and a little error may be generated. Therefore, precision of mobility sensing and compensation may be lowered.

In order to compensate the lowered precision, the mobility sensing is performed simultaneously in two or more sub pixels among K sub pixels commonly connected to each sensing line SL # m and mobility sensing of each of the K sub pixels is performed several times and the number of mobility sensing for each of the K sub pixels may be equalized. Individual current capability of the driving transistor DRT may be more precisely sensed.

That is, the driving transistor DRT in each of the K sub pixels commonly connected to each sensing line SL #m is applied with not the black data voltage VDATA_BLACK, but the data voltage VDATAs same number of times for a predetermined time, through the first node N1.

In the meantime, in the driving transistor DRT in each of the S sub pixels, when the voltage of the sensing line is sensed, a potential difference between the gate node and the source node may be equal to each other.

FIG. 14 illustrates exemplary views of sensing orders when two sub pixels are simultaneously sensed (S=2), three sub pixels are simultaneously sensed (S=3), and four sub pixels are simultaneously sensed (S=4) among four sub pixels R, W, G, and B commonly connected to one sensing line SL #m when mobility sensing according to the present exemplary embodiments is performed.

In FIG. 14, when S=2, the number of mobility sensing of each sub pixel in accordance with the sensing order is as follows. Mobility sensing is performed three times in each of the four sub pixels R, W, G, and B during a total of six times of mobility sensing.

In FIG. 14, when S=3, the number of mobility sensing of each sub pixel in accordance with the sensing order is as follows. Mobility sensing is performed six times in each of the four sub pixels R, W, G, and B during a total of eight times of mobility sensing.

In FIG. 14, when S=4, the number of mobility sensing of each sub pixel in accordance with the sensing order is as follows. Mobility sensing is performed ten times in each of the four sub pixels R, W, G, and B during a total of ten times of mobility sensing.

As described above, when the mobility sensing is performed simultaneously in two or more sub pixels among K sub pixels R, W, G, and B commonly connected to one sensing line SL #m, the mobility sensing for each of K sub pixels R, W, G, and B is preformed several times and the number of times of mobility sensing for each of K sub pixels is equalized by the control of the timing controller 140.

As described above, when the mobility sensing is performed simultaneously in two or more sub pixels among K sub pixels R, W, G, and B commonly connected to one sensing line SL #m, the mobility sensing for each of K sub pixels R, W, G, and B is preformed several times and the number of times of mobility sensing for each of K sub pixels is equalized. Therefore, the individual current capability of driving transistors DRT may be more precisely sensed.

In the meantime, the number S of sub pixels which include the driving transistor DRT which is applied with not the black data voltage, but the data voltage VDATAs for mobility sensing through the first node N1 among the K (K=4 in FIGS. 11 to 13) sub pixels commonly connected to each sensing line SL #m may be inversely proportional to a size of the driving transistor DRT included in each sub pixel.

Here, the size of the driving transistor DRT may be determined by a channel width W and a channel length L. That is, the size of the driving transistor DRT may be proportional to the channel width W and inversely proportional to the channel length L.

A current driving capability (that is, a current capability) of the driving transistor DRT is proportional to the channel width W and inversely proportional to the channel length L. That is, the current driving capability (that is, a current capability) of the driving transistor DRT is determined by W/L.

When the channel width W of the driving transistor is large, that is, the size of the driving transistor DRT is large so that the current driving capability of the driving transistor DRT is large, S may be set to be small. On the contrary, when the channel width W of the driving transistor small, that is, the size of the driving transistor DRT is small so that the current driving capability of the driving transistor DRT is small, S may be set to be large.

When the channel length L of the driving transistor is large, that is, the size of the driving transistor DRT is small so that the current driving capability of the driving transistor DRT is small, S may be set to be large. On the contrary, when the channel length L of the driving transistor is small, that is, the size of the driving transistor DRT is large so that the current driving capability of the driving transistor DRT is large, S may be set to be small.

Figure 15:
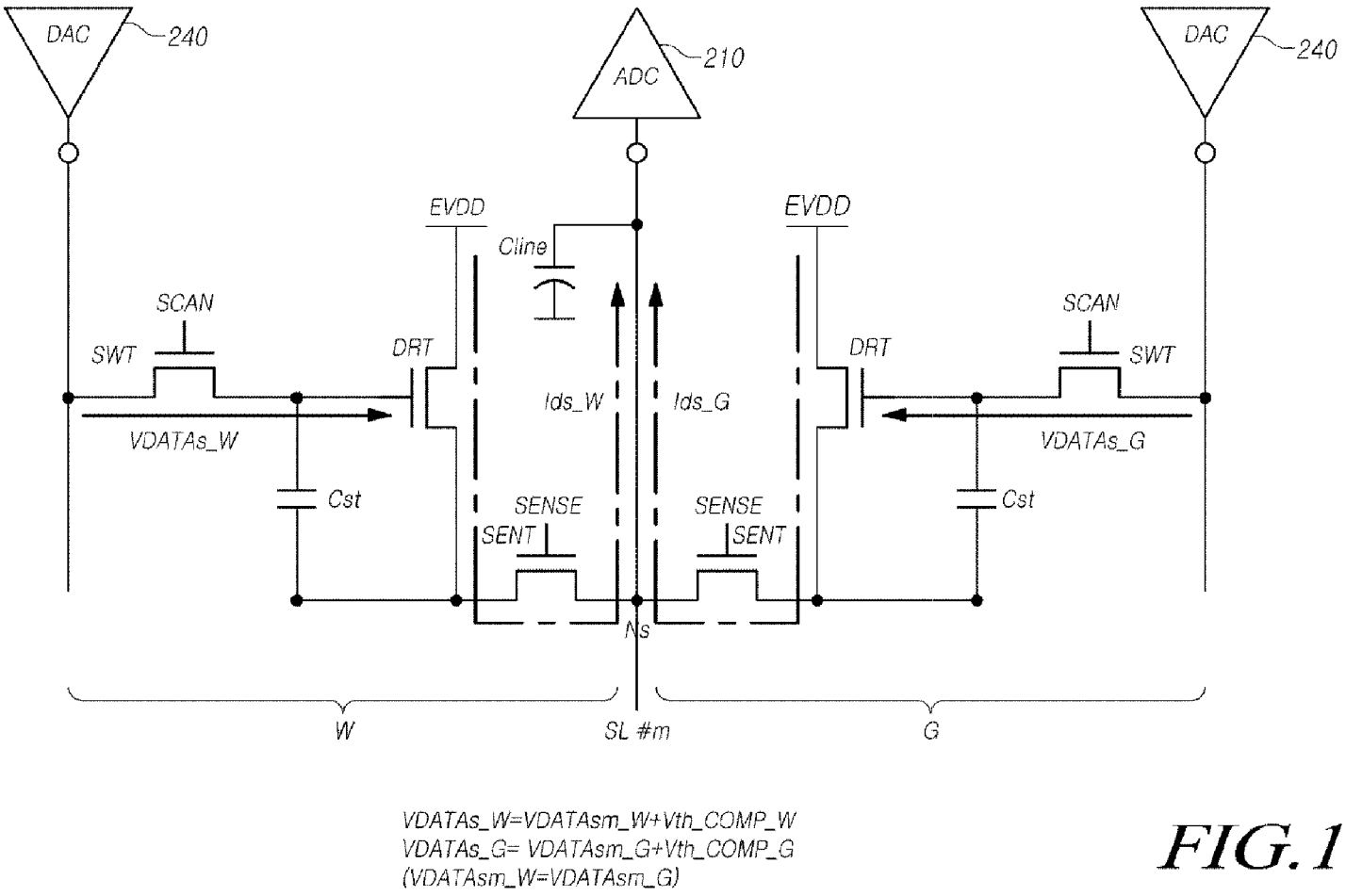
FIG. 15 is an exemplary view illustrating a mobility sensing programming when two sub pixels are simultaneously sensed among four sub pixels commonly connected to one sensing line when mobility sensing according to the present exemplary embodiments is performed.

FIG. 15 is an exemplary view illustrating a mobility sensing programming when mobility sensing for two sub pixels W and G among four sub pixels R, W, G, and B commonly connected to one sensing line SL #m is performed when mobility sensing according to the present exemplary embodiments is performed.

Referring to FIG. 15, during a mobility sensing period, a data voltage VDATAs_W for mobility sensing which is higher than the black data voltage (for example, 0 V) is applied to the first node N1 of the driving transistor DRT of the W sub pixel and simultaneously with this, a data voltage VDATAs_G for mobility sensing which is higher than the black data voltage (for example, 0 V) is applied to the first node N1 of the driving transistor DRT of the G sub pixel.

Thereafter, after a predetermined time has elapsed, a voltage which is charged in the line capacitor Cline by the current Ids_Total which flows into the sensing line SL #m, that is, a voltage of the sensing line SL #m is sensed.

Here, the current Ids_Total which flows into the sensing line SL #m is a sum of a current Ids_W which flows through the driving transistor DRT of the W sub pixel and a current Ids_G which flows through the driving transistor DRT of the G sub pixel.

That is, the current Ids_Total which flows into the sensing line SL #m is a current which flows by combining the current capability of the driving transistor DRT of the W sub pixel and a current capability of the driving transistor DRT of the G sub pixel.

Therefore, the voltage sensed by the analog to digital converter 210 is sensed by combining the current capabilities of two transistors and the combined current capability (mobility) of two transistors is represented by the following Equation 2.

Equation 2

$$\begin{aligned}\text{Ids_Total} &= \text{Ids_W} + \text{Ids_G}\\ &= Kw \times (\text{VDATAs_W} - \text{Vth_W})^2 + Kg \times (\text{VDATAs_G} - \text{Vth_G})^2\\ &= Kw \times ((\text{VDATAms_W} + \text{Vth_COMP_W}) - \text{Vth_W})^2 + Kg \times ((\text{VDATAms_G} + \text{Vth_COMP_G}) - \text{Vth_G})^2\end{aligned}$$

In Equation 2, Kw and Kg are determined by unique values (μ: mobility (electron mobility)), Cox: oxide capacitance, W: channel width, L: channel length) of the driving transistor DRT of each of the W sub pixel and the G sub pixel and may be ½×μ×Cox×W/L.

Further, VDATAs_W is a data voltage for mobility sensing which is supplied to the W sub pixel and is represented by a sum of a voltage component VDATAms_W for mobility sensing and a voltage component Vth_COMP_W for threshold voltage compensation. Vth_W is a threshold voltage of the driving transistor DRT in the W sub pixel.

Further, VDATAs_G is a data voltage for mobility sensing which is supplied to the W sub pixel and is represented by a sum of a voltage component VDATAms_G for mobility sensing and a voltage component Vth_COMP_G for threshold voltage compensation. Vth_G is a threshold voltage of the driving transistor DRT in the G sub pixel.

In the meantime, the voltage component Vth_COMP_W for threshold voltage compensation in the W sub pixel is equal to the threshold voltage Vth_W of the driving transistor DRT in the W sub pixel. Further, the voltage component Vth_COMP_G for threshold voltage compensation in the G sub pixel is equal to the threshold voltage Vth_G of the driving transistor DRT in the G sub pixel.

In consideration to this, Equation 2 may be represented by the following Equation 3.

Equation 3

$$\begin{aligned}\text{Ids_Total} &= \text{Ids_W} + \text{Ids_G}\\ &= Kw \times ((\text{VDATAms_W} + \text{Vth_COMP_W}) - \text{Vth_W})^2 + Kg \times ((\text{VDATAms_G} + \text{Vth_COMP_G}) - \text{Vth_G})^2\\ &= Kw \times \text{VDATAms_W}^2 + Kg \times \text{VDATAms_G}^2\end{aligned}$$

In the meantime, the voltage component VDATAms_W for mobility sensing in the W sub pixel may be equal to the voltage component VDATAms_G for mobility sensing in the G sub pixel (VDATAms=VDATAms_W=VDATAms_G). Therefore, Equation 3 may be re-represented by the following Equation 4.

Equation 4

$$\begin{aligned}\text{Ids_Total} &= \text{Ids_W} + \text{Ids_G}\\ &= Kw \times ((\text{VDATAms_W} + \text{Vth_COMP_W}) - \text{Vth_W})^2 + Kg \times ((\text{VDATAms_G} + \text{Vth_COMP_G}) - \text{Vth_G})^2\\ &= Kw \times \text{VDATAms_W}^2 + Kg \times \text{VDATAms_G}^2\\ &= (Kw + Kg) \times VDATAms^2\end{aligned}$$

Referring to Equations 2 to 4, a current amount of total current Ids_Total which flows into the sensing line SL #m is equal to a sum of current amounts of a current Ids_W which flows through the driving transistor DRT in the W sub pixel and a current Ids_G which flows through the driving transistor DRT in the G sub pixel.

That is, the current amount of the total current Ids_Total which flows into the sensing line SL #m is determined by the sum of the current capabilities (mobilities) of the driving transistors DRT in the W sub pixel and the G sub pixel.

The compensator 230 figures out the current capability obtained by adding the current capability (mobility) of the driving transistors DRT in each of the W sub pixel and the G sub pixel, based on the sensing value of the charged voltage of the line capacitor Cline determined by the current amount of the total current Ids_Total which flows into the sensing line SL #m. Further, the compensator 230 may divide the added current capability by ½ or proportionally divide the added current capability in accordance with a proportion of the size W/L or a channel width W of the driving transistors DRT in the W sub pixel and the G sub pixel to figure out the current capability (mobility) of the driving transistor DRT in each of the W sub pixel and the G sub pixel.

The compensator 230 determines a gain for mobility compensation based on the current capability (mobility) which is individually figured out for the driving transistor DRT in each of the W sub pixel and the G sub pixel to perform data changing process by multiplying the gain and original data which is supplied to the data driver 120. Further, the compensator 230 supplies the changed data to the data driver 120, so that the mobility compensation is actually performed.

Figuring out the individual current capability (mobility) described above will be generalized to be described. The compensator 230 calculates an integrated current capability value obtained by adding individual current capability values for driving transistors in S sub pixels based on a sensed voltage of the sensing line SL confirmed from a digital value (sensing data) which is received from the analog to digital converter 210. The compensator 230 calculates individual current capability values of the driving transistors of S sub pixels from the calculated integrated current capability value as a mobility. The compensator 230 also performs a compensating process (for example, to determine a mobility compensation gain) which compensates a mobility of the driving transistor in each of S sub pixels, based on the calculated individual current capability value.

As a method for obtaining individual current capability values (mobility) of the S driving transistors from the integrated current capability value (integrated mobility), for the purpose of calculation efficiency, it is assumed that individual current capabilities of the driving transistors in the S sub pixels are equal to each other. The compensator 230 calculates the integrated current capability value obtained by adding the individual current capability values for the driving transistors in the S sub pixels based on the sensed voltage of the sensing line SL and calculates 1/S of the calculated integrated current capability value as individual current capability values of the driving transistor in each of S sub pixels.

As another method for obtaining individual current capability values (mobility) of the S driving transistors from the integrated current capability value (integrated mobility), the compensator 230 calculates an integrated current capability value obtained by adding individual current capability values for driving transistors in the S sub pixels, based on the sensed voltage of the sensing line SL. The compensator 230 further calculates the individual current capability values of the driving transistors in the S sub pixels from the calculated integrated current capability values, based on a ratio of the size or the channel width between the driving transistors in the S sub pixels.

For example, conceptually, when it is assumed that the integrated current capability value is 10 and a ratio between the size (or a channel width) of a driving transistor in a first sub pixel and the size (or a channel width) of a driving transistor in a second sub pixel is 2:3, the individual current capability value of the driving transistor in the first subpixel is 4 (=10*⅖) and the individual current capability value of the driving transistor in the second sub pixel is 6 (=10*⅗).

Information on the size or the channel width of the driving transistor in all sub pixels on the organic light emitting display panel 110 may be stored in a memory 220.

This method is performed by considering a calculation precision more than the calculation efficiency of the individual current capability value. Therefore, it is considered that the individual current capability of the driving transistor in each of the S sub pixels may vary depending on a physical standard (the size or the channel width) of each of the driving transistor.

As illustrated in FIG. 11, when mobility sensing is simultaneously performed in two sub pixels, a problem caused by an insufficient current amount is solved as compared with a case that a mobility is sensed only in one subpixel. Therefore, a problem in that the mobility sensing and mobility compensation are not satisfactorily performed due to insufficient current may be solved.

Figure 16:
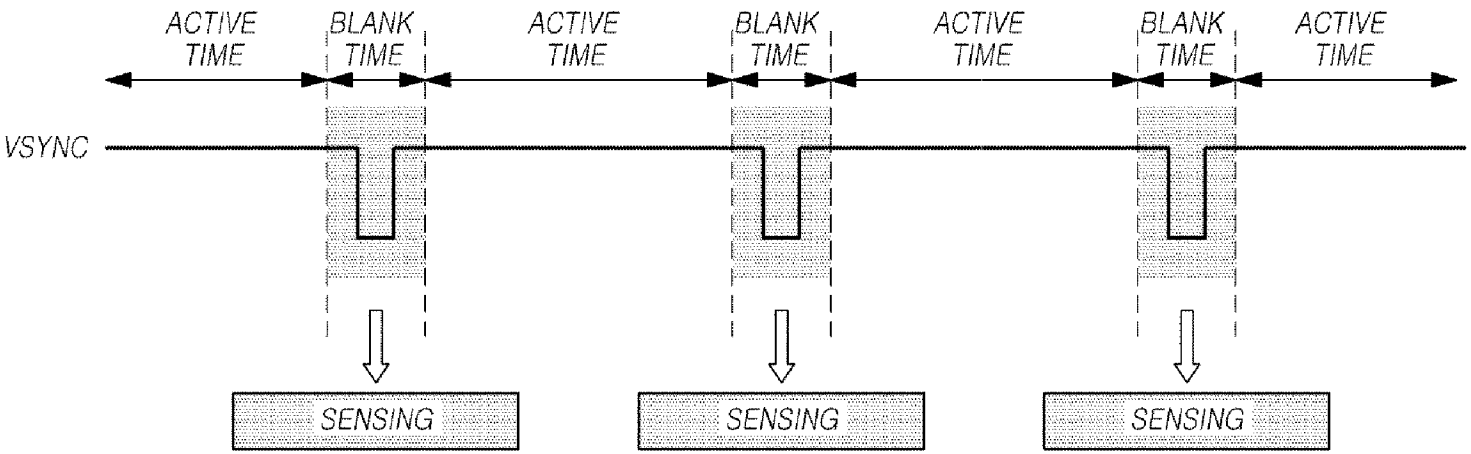
FIG. 16 is an exemplary view illustrating a period when the mobility sensing according to the present exemplary embodiments is performed.

FIG. 16 is an exemplary view illustrating a period when the mobility sensing according to the present exemplary embodiments is performed.

Referring to FIG. 16, for example, the mobility sensing according to the present exemplary embodiments may be performed for every blank time period with respect to a vertical synchronization signal VSYNC while displaying a screen.

Further, simultaneously, the driving transistor DRT in each of the S sub pixels in which the mobility sensing is being performed may be simultaneously applied with not the black data voltage VDATA_BLACK, but the data voltage VDATAs through the first node N1 during the blank time period.

That is, the data driver 120 may output a sensing data voltage VDATAs to S data lines which are connected to the S sub pixels to be sensed, among K data lines corresponding to one sensing line, during one blank time period.

As described above, the mobility sensing may be efficiently performed in real time while displaying a screen.

Figure 17:
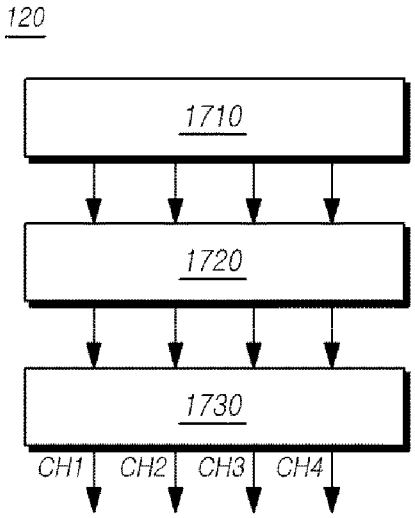
FIG. 17 is a block diagram of a data driver according to the present exemplary embodiments.
Figure 18:
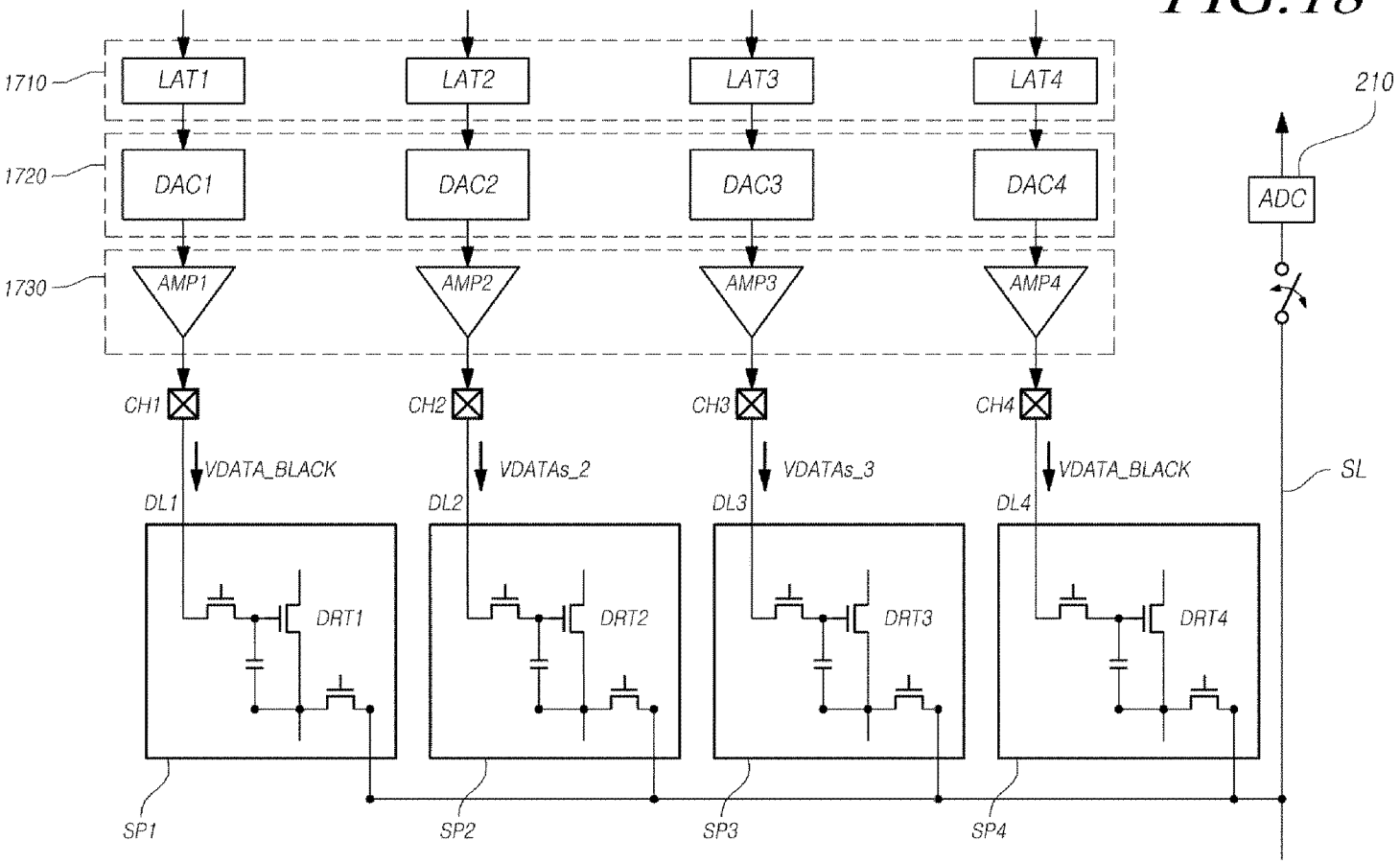
FIG. 18 is an exemplary view of a data driving operation of a data driver according to the present exemplary embodiments.

FIG. 17 is a block diagram of the data driver 120 according to the present exemplary embodiments and FIG. 18 is a detailed block diagram of the data driver 120 according to the present exemplary embodiments and illustrates an example of a data driving operation. However, it is assumed that K=4, S=2, and K−S=2 in FIGS. 17 and 18.

Referring to FIGS. 17 and 18, the data driver 120 according to the present exemplary embodiments may include a latch unit 1710, a digital to analog converting unit 1720, and an output unit 1730.

In the latch unit 1710, data corresponding to a plurality of channels CH1, CH2, CH3, CH4, . . . corresponding to a plurality of data lines DL1, DL2, DL3, DL4, . . . is stored. The digital to analog converting unit 1720 converts data for the plurality of channels CH1, CH2, CH3, CH4, . . . into an analog voltage. The output unit 1730 outputs the data voltage to the plurality of channels CH1, CH2, CH3, CH4, . . . based on the analog voltage.

The above-described latch unit 1710 may include latches LAT1, LAT2, LAT3, LAT4, . . . corresponding to the plurality of channels CH1, CH2, CH3, CH4, . . . . Here, the latches LAT1, LAT2, LAT3, LAT4, . . . for every channel may include a first latch and a second latch.

The above-described digital to analog converting unit 1720 may include digital to analog converters DAC1, DAC2, DAC3, DAC4, . . . corresponding to the plurality of channels CH1, CH2, CH3, CH4, . . . .

The above-described output unit 1730 may include output buffers AMP1, AMP2, AMP3, AMP4, . . . corresponding to the plurality of channels CH1, CH2, CH3, CH4, . . . .

Referring to FIGS. 17 and 18, the output unit 1730 may output sensing data voltages VDATAs_2 and VDATAs_3 to data lines DL2 and DL3 connected two sub pixels SP2 and SP3 among four sub pixels SP1, SP2, SP3, and SP4 commonly connected to one sensing line SL, among four data lines DL1, DL2, DL3, DL4, . . . corresponding to one sensing line SL, while data driving to measure a characteristic of the driving transistor in the organic light emitting display panel 110.

That is, the output unit 1730 may output the sensing data voltages VDATAs_2 and VDATAs_3 to the data lines DL2 and DL3 among four data lines DL1, DL2, DL3, DL4, . . . corresponding to one sensing line SL, while performing data driving to measure a characteristic of the driving transistor in the organic light emitting display panel 110.

When the sensing data voltages VDATAs_2 and VDATAs_3 are output to the data lines DL2 and DL3 which are connected to two sub pixels SP2 and SP3 to be sensed, the output unit 1730 may output a black data voltage VDATA_BLACK which is defined in advance as a non-sensing data voltage, to data lines DL1 and DL4 which is connected to two sub pixels SP1 and SP4, excluding two sub pixels SP2 and SP3 to be sensed.

That is, the output unit 1730 may output a black data voltage VDATA_BLACK, which is defined in advance as a non-sensing data voltage, to the remaining two data lines DL1 and DL4, excluding two data lines DL2 and DL3 to which the sensing data voltages VDATAs_2 and VDATAs_3 are output, from four data lines DL1, DL2, DL3, DL4, . . . corresponding to one sensing line SL, while performing data driving to measure a characteristic of the driving transistor in the organic light emitting display panel 110.

As described above, the sensing data voltages VDATAs_2 and VDATAs_3 may be applied to gate nodes of driving transistors DRT2 and DRT3 in two sub pixels SP2 and SP3 to be sensed, among four sub pixels SP1, SP2, SP3, and SP4 commonly connected to one sensing line SL. Further, a black data voltage VDATA_BLACK which is defined in advance as a non-sensing data voltage may be applied to gate nodes of the driving transistors DRT1 and DRT4 in the remaining two sub pixels SP1 and SP4.

Referring to FIG. 18, the data driver 120 may further include an analog to digital converter 210 which is electrically connected to one sensing line SL corresponding to K data lines DL1, DL2, DL3, and DL4, through a switch SW.

When the analog to digital converter 210 is connected to the sensing line SL in accordance with a switching operation (which operates in accordance with control of the timing controller 140) of the switch SW, the analog to digital converter 210 senses a voltage (sensing line voltage) of the connected sensing line SL and converts the sensed voltage into a digital value. The analog to digital converter 210 outputs the digital value to the timing controller 140 or the compensator 230 as sensing data.

The voltage sensed by the analog to digital converter 210 is a voltage which charges a line capacitor Cline on the sensing line SL by the sum of the currents which flow through the driving transistors DRT2 and DRT3 in two sub pixels SP2 and SP3 corresponding to sub pixels to be sensed, that is, two sub pixels SP2 and SP3 which are connected to two data lines DL2 and DL3 to which the sensing data voltage is output.

In the meantime, among the S data lines, the data driver 120 simultaneously outputs sensing data voltages having the same voltage values to data lines which are connected to the sub pixels including driving transistors having the same characteristic (for example, a threshold voltage) and outputs sensing data voltages having different voltage values to data lines connected to sub pixels including driving transistors having different characteristics (for example, a threshold voltage).

For example, referring to FIG. 18, when a threshold voltage of the driving transistor DRT2 of the sub pixel SP2 is equal to a threshold voltage of the driving transistor DRT3 of the sub pixel SP3, the sensing data voltage VDATAs_2 which is output to the data line DL2 may be equal to the sensing data voltage VDATAs_3 which is output to the data line DL3.

When the threshold voltage of the driving transistor DRT2 of the sub pixel SP2 is different from the threshold voltage of the driving transistor DRT3 of the sub pixel SP3, the sensing data voltage VDATAs_2 which is output to the data line DL2 may be different from the sensing data voltage VDATAs_3 which is output to the data line DL3.

According to the present exemplary embodiment, a data driver 120, an organic light emitting display panel 110, an organic light emitting display device 100, and a method for driving an organic light emitting display device which may more precisely perform mobility sensing and compensation of a driving transistor may be provided.

According to the present exemplary embodiments, a data driver 120, an organic light emitting display panel 110, an organic light emitting display device 100, and a method for driving an organic light emitting display device which are capable of performing mobility sensing within a short sensing time in spite of a voltage which is not so high and an insufficient current capability of the driving transistor may be provided.

According to the present exemplary embodiments, a data driver 120, an organic light emitting display panel 110, an organic light emitting display device 100, and a method for driving an organic light emitting display device which are capable of performing mobility sensing within a short sensing time in spite of a voltage which is not so high without increasing the size of the driving transistor may be provided.

According to the present exemplary embodiments, a data driver 120, an organic light emitting display panel 110, an organic light emitting display device 100, and a method for driving an organic light emitting display device which are capable of performing mobility sensing within a short sensing time in spite of a voltage which is not so high while achieving high resolution and high aperture ratio may be provided.

It will be appreciated that technical spirit of the present discloses have been described herein for purposes of illustration by the above description and the accompanying drawings, and that combination, separation, substitution, and modifications of components may be made by those skilled in the art without departing from the scope and spirit of the present discloses. Therefore, the exemplary embodiments of the present disclosure are provided for illustrative purposes only but not intended to limit the technical concept of the present disclosure. The scope of the technical concept of the present disclosure is not limited thereto. The protection scope of the present discloses should be interpreted based on the following appended claims and it should be appreciated that all technical spirits included within a range equivalent thereto are included in the protection scope of the present discloses.

What is claimed is:

1. An organic light emitting display device, comprising:

an organic light emitting display panel in which a plurality of data lines and a plurality of gate lines are disposed, a plurality of sub pixels each including an organic light emitting diode and a driving transistor which drives the organic light emitting diode are disposed, and at least one sensing line is disposed to correspond to K data lines, wherein $K \geq 2$;

a data driver which outputs a data voltage to each of the plurality of data lines; and a gate driver which drives the plurality of gate lines, wherein the data driver simultaneously outputs sensing data voltages to S data lines among K data lines corresponding to the at least one sensing line, while measuring a characteristic of the driving transistors, where $2 \leq S \leq K$, and outputs a non-sensing data voltage to K−S data lines excluding the S data lines to which the sensing data voltage is output, wherein the data driver outputs the sensing data voltage to the S data lines a same number of times for a predetermined time, and outputs the non-sensing data voltage to the K−S data lines a same number of times for the predetermined time, and wherein the organic light emitting display further comprises:

an analog to digital converter which is electrically connected to the at least one sensing line, senses a voltage of the at least one sensing line to convert the voltage into a digital value and outputs the digital value, and a timing controller which calculates an integrated current capability value obtained by adding individual current capability values for driving transistors in S sub pixels connected each to one of the S data lines, based on the sensed voltage of the at least one sensing line confirmed from the digital value received from the analog to digital converter and calculates individual current capability values of the driving transistors in the S sub pixels from the calculated integrated current capability values, and compensates a mobility of the driving transistors in the S sub pixels, based on the calculated individual current capability value.

2. The organic light emitting display device according to claim 1, wherein a current which flows in the at least one sensing line corresponding to the K data lines corresponds to a sum of currents which flow through the driving transistors in the S sub pixels connected to the S data lines, among K sub pixels which are connected to the K data lines and commonly connected to the at least one sensing line.

3. The organic light emitting display device according to claim 1, wherein the analog to digital converter is included in the data driver.

4. The organic light emitting display device according to claim 1, wherein the timing controller calculates 1/S of the calculated integrated current capability value as individual current capability values of the driving transistor in each of S sub pixels.

5. The organic light emitting display device according to claim 1, wherein the timing controller calculates the individual current capability values of the driving transistors in the S sub pixels from the calculated integrated current capability values, based on a ratio of the size or the channel width between the driving transistors in the S sub pixels.

6. The organic light emitting display device according to claim 1, wherein the data driver outputs a predetermined black data voltage which is defined as the non-sensing data voltage, to the K−S data lines excluding the S data lines to which the sensing data voltage is output, from the K data lines, while measuring the characteristic of the driving transistors.

7. The organic light emitting display device according to claim 1, wherein the S sub pixels connected to the S data lines are selected, as sub pixels which are simultaneously sensed, from K sub pixels which are connected to the K data lines.

8. The organic light emitting display device according to claim 1, wherein the data driver outputs the sensing data voltage to the S data lines during one blank time period.

9. The organic light emitting display device according to claim 1, wherein the data driver simultaneously outputs sensing data voltages having the same voltage values to data lines connected to sub pixels including driving transistors having the same characteristic, among the S data lines, and the data driver outputs sensing data voltages having different voltage values to data lines connected to sub pixels including driving transistors having different characteristics.

10. A driving method of an organic light emitting display device which includes an organic light emitting display panel in which a plurality of data lines and a plurality of gate lines are disposed, a plurality of sub pixels each including an organic light emitting diode and a driving transistor which drives the organic light emitting diode are disposed, and at least one sensing line is disposed corresponding to K data lines where K≥2; a data driver which outputs a data voltage to each of the plurality of data lines; and a gate driver which drives the plurality of gate lines, the driving method comprising:

simultaneously outputting sensing data voltages to S data lines among K data lines corresponding to the at least one sensing line, while measuring a characteristic of the driving transistors, wherein 2≤S≤K;

outputting a non-sensing data voltage to K−S data lines excluding the S data lines to which the sensing data voltage is output; and sensing a voltage of the at least one sensing line corresponding to the K data lines, wherein the sensing data voltage is output to the S data lines a same number of times for a predetermined time, and the non-sensing data voltage is output to the K−S data lines a same number of times for the predetermined time, and wherein the driving method further comprises:

sensing a voltage of the at least one sensing line to convert the voltage into a digital value and outputting the digital value; and calculating an integrated current capability value obtained by adding individual current capability values for the driving transistors in S sub pixels of the plurality of sub pixels connected each to one of to the S data lines, based on the sensed voltage of the at least one sensing line confirmed from the digital value received and calculating individual current capability values of the driving transistors in the S sub pixels from the calculated integrated current capability values, and compensating a mobility of the driving transistors in the S sub pixels, based on the calculated individual current capability value.

11. The driving method according to claim 10, wherein in the outputting of sensing data voltages, the organic light emitting display device outputs a predetermined black data voltage which is defined in advance as the non-sensing data voltage to the K−S data lines while outputting the sensing data voltage to the S data lines.

12. An organic light emitting display panel, comprising:

a plurality of data lines disposed in a first direction;

a plurality of gate lines disposed in a second direction;

a plurality of sub pixels each including an organic light emitting diode and a driving transistor which drives the organic light emitting diode; and at least one sensing line which is disposed for every K sub pixel columns, where K ≥2, wherein while measuring a characteristic of the driving transistors, S sub pixels among K sub pixels commonly connected to each of the sensing lines are simultaneously supplied with a sensing data voltage and K−S sub pixels are simultaneously supplied with a non-sensing data voltage, where 2 ≤S≤K, wherein the sensing data voltage is supplied to the S sub pixels a same number of times for a predetermined time, and the non-sensing data voltage is supplied to the K−S sub pixels a same number of times for the predetermined time, and wherein the organic light emitting display panel further comprises:

an analog to digital converter which is electrically connected to the at least one sensing line, senses a voltage of the at least one sensing line to convert the voltage into a digital value and outputs the digital value, and a timing controller which calculates an integrated current capability value obtained by adding individual current capability values for the driving transistors in the S sub pixels, based on the sensed voltage of the at least one sensing line confirmed from the digital value received from the analog to digital converter and calculates individual current capability values of the driving transistors in the S sub pixels from the calculated integrated current capability values, and compensates a mobility of the driving transistors in the S sub pixels, based on the calculated individual current capability value.

13. A data driver, comprising:

a latch unit which stores data corresponding to a plurality of channels corresponding to a plurality of data lines;

a digital to analog converter which converts the data into an analog voltage for each of the plurality of channels; and an output unit which outputs a data voltage to the plurality of channels, based on the analog voltage, wherein the output unit simultaneously outputs sensing data voltages to S data lines among K data lines corresponding to one sensing line, while data driving to measure a characteristic of a plurality of driving transistors in an organic light emitting display panel, where $K \geq 2$ and $2 \leq S \leq K$, and outputs a non-sensing data voltage to K−S data lines excluding the S data lines to which the sensing data voltage is output, and wherein the output unit outputs the sensing data voltage to the S data lines a same number of times for a predetermined time, and outputs the non-sensing data voltage to the K−S data lines a same number of times for the predetermined time, and wherein the data driver further comprises:

an analog to digital converter which is electrically connected to the one sensing line, senses a voltage of the one sensing line to convert the voltage into a digital value and outputs the digital value, and a timing controller which calculates an integrated current capability value obtained by adding individual current capability values for driving transistors among the plurality of driving transistors corresponding to S sub pixels connected each to one of the S data lines, based on the sensed voltage of the one sensing line confirmed from the digital value received from the analog to digital converter and calculates individual current capability values of the driving transistors in the S sub pixels from the calculated integrated current capability values, and compensates a mobility of the driving transistors in the S sub pixels, based on the calculated individual current capability value.

14. The data driver according to claim 13, wherein the output unit outputs a predetermined black data voltage which is defined as the non-sensing data voltage, to the K−S data lines excluding the S data lines to which the sensing data voltage is output, from the K data lines corresponding to the one sensing line.

15. The data driver according to claim 13, wherein the sensed voltage value is a voltage which charges a line capacitor on the one sensing line by a sum of currents which flow through the driving transistors in the S sub pixels connected to the S data lines.

* * * * *